US009290024B2

(12) United States Patent
Yamashiro et al.

(10) Patent No.: US 9,290,024 B2
(45) Date of Patent: Mar. 22, 2016

(54) PRINTER

(71) Applicant: Brother Kogyo Kabushiki Kaisha, Nagoya-shi, Aichi-ken (JP)

(72) Inventors: Jun Yamashiro, Nagoya (JP); Tetsuya Ishiyama, Chita (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/609,766

(22) Filed: Jan. 30, 2015

(65) Prior Publication Data

US 2015/0217579 A1 Aug. 6, 2015

(30) Foreign Application Priority Data

Jan. 31, 2014 (JP) ..... 2014-016897

(51) Int. Cl.

| | |
|---|---|
| ***B41J 29/38*** | (2006.01) |
| ***B41J 11/66*** | (2006.01) |
| ***B41J 3/407*** | (2006.01) |

(52) U.S. Cl.

CPC ..... *B41J 11/666* (2013.01); *B41J 3/4075* (2013.01)

(58) Field of Classification Search

CPC . H01L 2924/00; B41J 2/16585; B26D 1/085; B26D 1/205

See application file for complete search history.

(56) References Cited

U.S. PATENT DOCUMENTS

| | | | | |
|---|---|---|---|---|
| 5,861,898 | A * | 1/1999 | Nakanishi | 347/19 |
| 6,102,596 | A * | 8/2000 | Komori et al. | 400/621 |
| 6,393,223 | B2 * | 5/2002 | Sasaki et al. | 396/395 |
| 7,059,769 | B1 * | 6/2006 | Potega | 374/185 |
| 2010/0225698 | A1 * | 9/2010 | Silverbrook | 347/32 |
| 2011/0292278 | A1 | 12/2011 | Kurihara | |
| 2013/0010083 | A1 * | 1/2013 | Silverbrook | 348/47 |
| 2014/0111595 | A1 * | 4/2014 | Vetterling et al. | 347/223 |

FOREIGN PATENT DOCUMENTS

| | | | |
|---|---|---|---|
| JP | 3071625 | B2 | 7/2000 |
| JP | 2012-152990 | A | 8/2012 |
| JP | 5201241 | B2 | 6/2013 |

* cited by examiner

*Primary Examiner* — Stephen Meier
*Assistant Examiner* — John P Zimmermann
(74) *Attorney, Agent, or Firm* — Banner & Witcoff, Ltd.

(57) ABSTRACT

The disclosure discloses a printer comprising a feeder, a printing head, a movable blade, a blade receiving member, a constant voltage circuit, a route switching device, and a switching control portion. The constant voltage circuit outputs a constant voltage to a secondary side based on a primary-side voltage supplied from a battery. The route switching device switches a current supply route from the battery to a motor to either one of a first route by which the constant voltage on the secondary side from the constant voltage circuit is supplied from the battery, and a second route by which the primary-side voltage is supplied without passing through the constant voltage circuit. The switching control portion controls the route switching device so that, triggered by non-detection of execution of the partial cutting, the current supply route is switched from the first route to the second route.

12 Claims, 15 Drawing Sheets

PRINTER

CROSS-REFERENCE TO RELATED APPLICATION

The present application claims priority from Japanese Patent Application No. 2014-16897, which was filed on Jan. 31, 2014, the disclosure of which is incorporated herein by reference in its entirety.

BACKGROUND

1. Field

The present disclosure relates to a printer that forms desired print on a recording medium.

2. Description of the Related Art

There are known printers that form desired print on a print-receiving medium. According to this printer of prior art, desired print is formed by printing means on a print-receiving medium fed by feeding means. Further, this printer comprises a half-cutting unit that partially cuts the print-receiving medium in a thickness direction. The print-receiving medium after print formation is partially cut in the thickness direction by cooperation between a movable blade and a blade receiving member included in the half-cutting unit. The advancing and retreating movement of the movable blade that performs the partial cutting is performed by a driving force of a motor.

However, depending on the user application and model, a printer such as described above may be driven by a battery. In such a case, the motor is driven by current from the battery. At this time, a constant voltage circuit may be provided to ensure that the voltage supplied to the motor does not become transitionally excessive (so that the voltage does not become greater than a rated voltage of the motor, for example). The constant voltage circuit is capable of outputting a predetermined constant voltage to a secondary side based on a primary-side voltage supplied from the battery stored in a battery storage part.

Nevertheless, since the constant voltage circuit exhibits the voltage adjusting function described above, voltage drops up to a certain level in the interior of the constant voltage circuit cannot be avoided. Accordingly, when the battery is consumed due to usage of the printer and the electromotive force has gradually decreased, the voltage supplied to the motor can decrease relatively quickly to or below a minimum voltage capable of driving the movable blade (in an amount equivalent to the voltage drop in the constant voltage circuit). As a result, the partial cutting of the print-receiving medium cannot be executed, resulting in inconvenience.

SUMMARY

It is therefore an object of the present disclosure to provide a printer capable of executing partial cutting of the print-receiving medium even if the electromotive force of the battery has decreased, thereby improving convenience.

In order to achieve the above-described object, according to the aspect of the present application, there is provided a printer comprising a feeder configured to feed a long recording medium, a printing head configured to perform desired printing on the recording medium fed by the feeder, a movable blade that is configured to partially cut the recording medium in a thickness direction by performing a advancing and retreating movement in a direction orthogonal to a feeding path of the recording medium, and is provided near the feeding path by the feeder, a blade receiving member that is configured to receive the movable blade that advances toward the feeding path and to perform the partial cutting in coordination with the movable blade, and is provided on a side opposite the movable blade, sandwiching the feeding path, a battery storage part configured to store at least a battery, a motor configured to generate a driving force for performing the advancing and retreating movement of the movable blade, a constant voltage circuit configured to output a constant voltage to a secondary side based on a primary-side voltage supplied from the battery stored in the battery storage part, a route switching device configured to selectively switch a current supply route from the battery to the motor to either one of a first route by which the constant voltage on the secondary side from the constant voltage circuit is supplied based on the primary-side voltage from the battery, and a second route by which the primary-side voltage from the battery is supplied without passing through the constant voltage circuit, a cutting detection device configured to detect that the partial cutting has been performed during execution of the partial cutting on the recording medium by the movable blade, and a switching control portion configured to control the route switching device so that, triggered by non-detection of execution of the partial cutting by the cutting detection device with the current supply route switched to the first route by the route switching device, the current supply route is switched from the first route to the second route.

According to the printer of the present disclosure, desired print is formed by a printing head on a recording medium fed by a feeder. The recording medium after print formation is partially cut in the thickness direction by the cooperation between the movable blade and blade receiving member, and is then ready for use by the user. The advancing and retreating movement of the movable blade that performs the partial cutting is performed by a driving force of a motor.

The motor is driven by the current from the battery stored in the battery storage part. At this time, a constant voltage circuit is provided to ensure that the voltage supplied to the motor does not become transitionally excessive (so that the voltage does not become greater than the rated voltage of the motor, for example). That is, this constant voltage circuit is capable of outputting a predetermined constant voltage to a secondary side based on a primary-side voltage supplied from the battery stored in the battery storage part.

Then, according to the present disclosure, two current supply routes from the battery to the motor are prepared: a first route and a second route. The first route is a route by which a constant voltage on the secondary side from the constant voltage circuit is supplied to the motor based on the primary-side voltage from the battery, as described above. Further, the second route, unlike the above, is a route by which the primary-side voltage from the battery is supplied to the motor as is without passing through the constant voltage circuit. Then, route switching device that switches the above two routes, and cutting detecting device capable of detecting whether or not the partial cutting by the movable blade has been fully executed are provided.

Then, according to the printer of the present disclosure, first the route switching device switches the current supply route from the battery to the motor to the first route by the control of the switching control portion. With this arrangement, it is possible to supply stabilized constant voltage to the motor. Subsequently, when the electromotive force of the battery decreases by consumption and the voltage supplied to the motor is less than the minimum voltage, the movable blade can no longer execute the partial cutting. Then, triggered by non-detection of execution of the partial cutting by cutting detecting device, the route switching device switches the current supply route from the battery to the motor to the second route, by the control of the switching control portion. With this arrangement, the current from the battery is supplied to the motor without passing through the constant voltage circuit, making it possible to increase the voltage supplied to the motor by an amount equivalent to the amount of disappearance in the voltage drop in the constant voltage circuit. As a result, it is possible to drive the movable blade and execute the partial cutting of the recording medium, thereby making it possible to improve user convenience.

DETAILED DESCRIPTION OF THE PREFERRED EMBODIMENTS

The following described an embodiment of the present disclosure with reference to accompanying drawings. In the following descriptions, the lower right side, the upper left side, the lower left side, the upper right side, the upper side, and the lower side in FIG. 1 conveniently refer to the front side, the rear side, the left side, the right side, the upper side, and the lower side of a tape printer 1 and a tape cassette 30, respectively. In to this embodiment, various tapes (a thermal paper tape, print-receiving tape 57 described later, double-sided adhesive tape, tube tape, and film tape, for example) stored in the tape cassette 30 are generally referred to as "tape."

Figure 1:
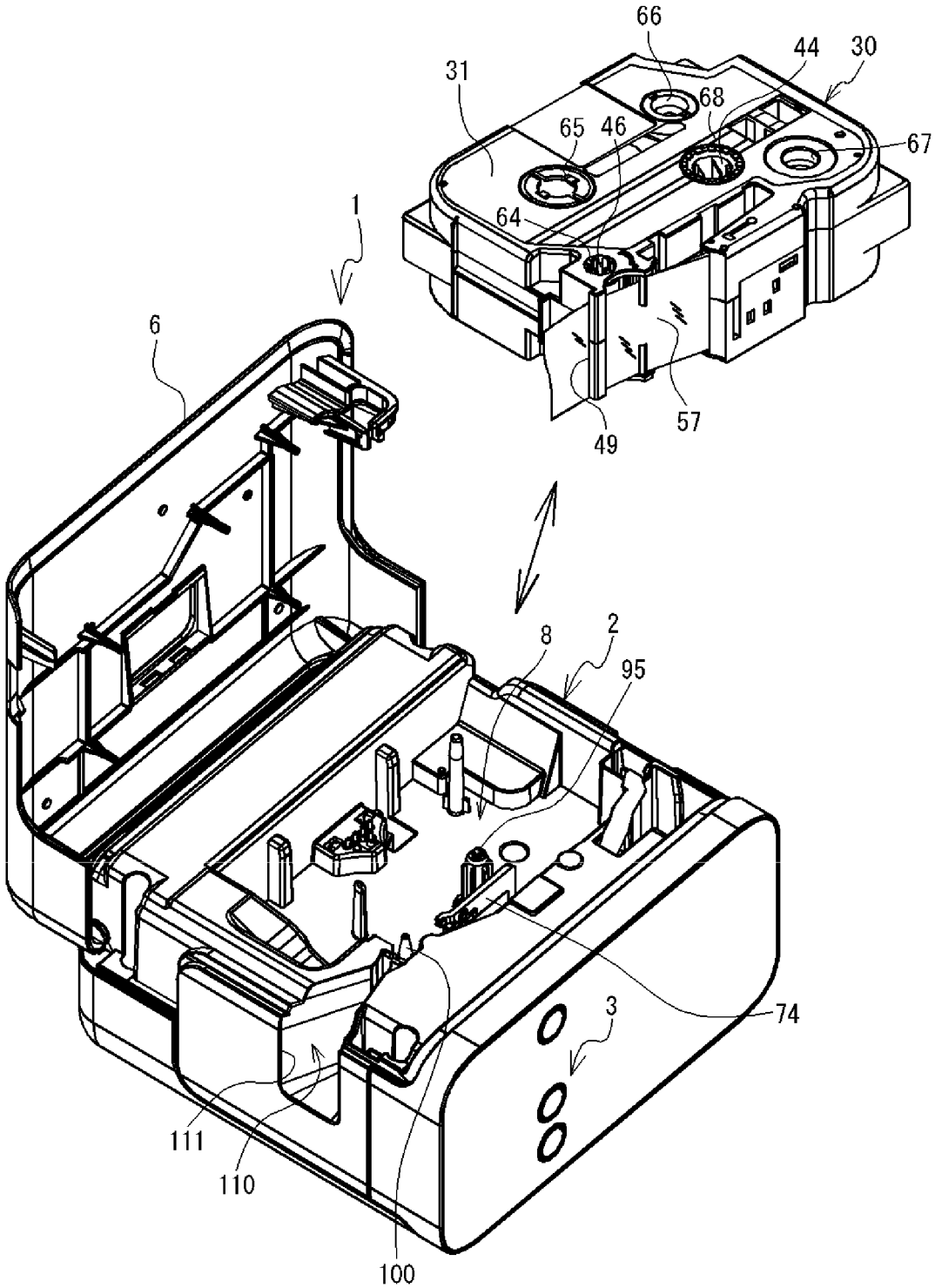
FIG. 1 is a perspective view of the tape printer and tape cassette.
Figure 2:
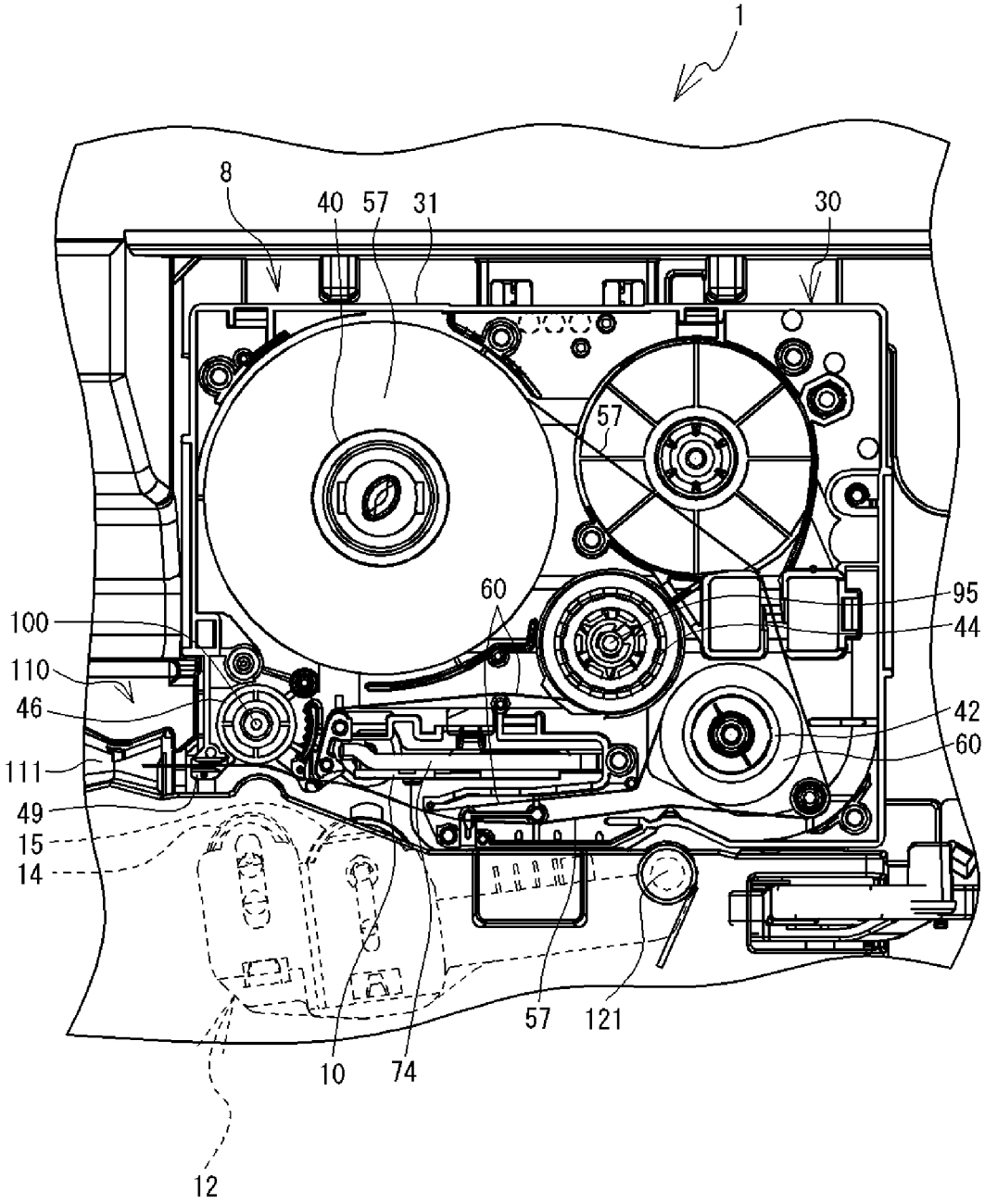
FIG. 2 is a plan view showing the tape cassette mounted to the cassette mounting part.
Figure 3:
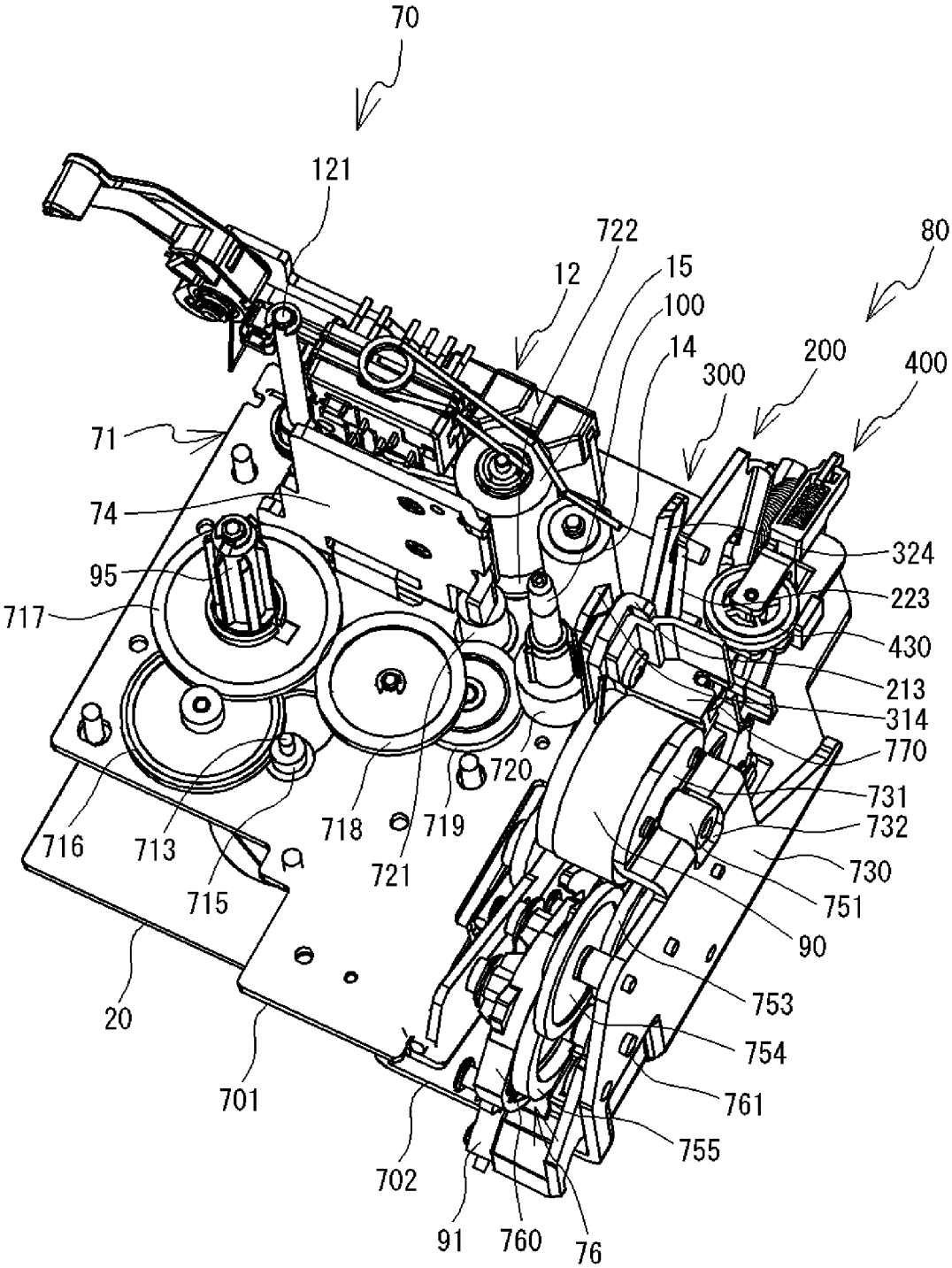
FIG. 3 is a perspective view showing the print formation unit diagonally from above.

The following describes the tape printer 1 with reference to FIGS. 1-3. In FIG. 2, an upper surface of a cassette case 31 is removed for ease of understanding. The tape printer 1 is a general-purpose tape printer capable of using various tape cassettes, such as a thermal type, receptor type, laminate type, tube type, and the like, in a single unit.

As shown in FIG. 1, the tape printer 1 comprises a main body cover 2 having a substantially rectangular parallelepiped shape. A switch 3 for operating the tape printer 1, such as a power switch of the tape printer 1, is disposed on a front surface of the main body cover 2. A battery storage part (not shown) opened and closed by an opening/closing cover is disposed on a back surface side of the main body cover 2. The battery storage part stores a battery 150 (refer to FIG. 14 described later) for supplying power to a tape driving motor 711 (refer to FIG. 4 described later), a cutter driving motor 90, a thermal head 10, and the like. The tape printer 1 is connectable to a personal computer (not shown; hereinafter referred to as "PC") via a cable (not shown) and the like. The tape printer 1 prints characters on the print-receiving tape 57 based on character (text, number, graphic, and the like) data transmitted from the PC, for example.

A cassette cover 6 that is opened and closed when the tape cassette 30 is replaced is disposed on an upper surface of the tape printer 1. The cassette cover 6 is a cover substantially rectangular in shape in the planar view. The cassette cover 6 is supported at both left and right ends above a back surface of the main body cover 2, and is capable of pivoting between a closed position (not shown) and an open position shown in FIG. 1. A cassette mounting part 8 which is an area where the tape cassette 30 is detachable is disposed on the main body cover 2. The cassette mounting part 8 is covered when the cassette cover 6 is in the closed position, and exposed when the cassette cover 6 is in the open position.

A discharging exit 111 is disposed on a left side surface of the main body cover 2. The discharging exit 111 is an opening where a tape with print after print is formed on the above described print-receiving tape 57 is discharged from the cassette mounting part 8. The main body cover 2 comprises a tape discharging part 110 where a feeding path of the tape with print is formed between the cassette mounting part 8 and the discharging exit 111. A cutting mechanism 80 described later (refer to FIG. 3 described later) is disposed in the interior of the tape discharging part 110.

As shown in FIG. 1 and FIG. 2, a head holder 74 stands on the front part of the cassette mounting part 8. The thermal head 10 comprising a heating body (not shown) is disposed on the front surface of the head holder 74. A ribbon take-up shaft 95 stands rearward from the head holder 74. The ribbon take-up shaft 95 is a shaft body detachable from a ribbon take-up spool 44 of the tape cassette 30. A tape driving shaft 100 stands on the left side of the head holder 74. The tape driving shaft 100 is a shaft body detachable from a tape driving roller 46 of the tape cassette 30.

An arm-shaped platen holder 12 that extends in the left-right direction is disposed on the front side of the head holder 74. The platen holder 12 is rockably supported about a shaft support part 121. A platen roller 15 and a movable feeding roller 14 are rotatably supported on a left end of the platen holder 12. The platen roller 15 faces the thermal head 10, and is capable of coming in contact with and moving away from the thermal head 10. The movable feeding roller 14 faces the tape driving roller 46 mounted to the tape driving shaft 100, and is capable of coming in contact with and moving away from the tape driving roller 46. The tape driving motor 711 (refer to FIG. 4 described later), which is a stepping motor, is disposed on the lower side of the cassette mounting part 8.

As shown in FIG. 2 and FIG. 3, when the cassette cover 6 (refer to FIG. 1) is closed, the platen holder 12 moves toward the print position. The platen holder 12 moved to the print position is near the cassette mounting part 8. At this time, a gear 722 disposed on the lower side of the platen roller 15 meshes with a gear 721, and a gear 723 disposed on the lower side of the movable feeding roller 14 meshes with a gear 720.

The tape cassette 30 will now be described with reference to FIG. 1 and FIG. 2. The tape cassette 30 is a general-purpose cassette wherein the aforementioned thermal type, receptor type, laminate type, tube type, and the like can be mounted by suitably changing the type of tape stored in the interior, the ink ribbon status, and the like. FIG. 2 illustrates the tape cassette 30 of a receptor type.

As shown in FIG. 1 and FIG. 2, the tape cassette 30 comprises the box-shaped cassette case 31. A discharge guiding part 49 that guides the tape discharged from the tape cassette 30 is disposed on the left front part of the cassette case 31. The cassette case 31 comprises support holes 65-68 for rotatably supporting spools mounted inside the cassette case 31.

The support hole 65 rotatably supports a first tape spool 40 which winds a first tape. The support hole 67 rotatably supports a ribbon spool 42 which winds an unused ink ribbon 60. The support hole 68 rotatably supports the ribbon take-up spool 44 for taking up the used ink ribbon 60. The support hole 66 rotatably supports a second tape spool (not shown) which winds a second tape.

In the tape cassette 30 of a receptor type shown in FIG. 2, the support hole 65 supports the first tape spool 40 which winds the print-receiving tape 57, which is the first tape. The print-receiving tape 57 in this embodiment is a layered tape wherein a print layer and separation layer are layered via an adhesive. In the tape cassette 30 of the receptor type, the second tape is not used, and therefore the support hole 66 does not support the second tape spool. Although not shown, in the tape cassette 30 of a laminate cassette, the support hole 65 supports the first tape spool 40 which winds a double-sided adhesive tape, which is the first tape. The support hole 66 supports the second tape spool which winds a film tape, which is the second tape.

Figure 4:
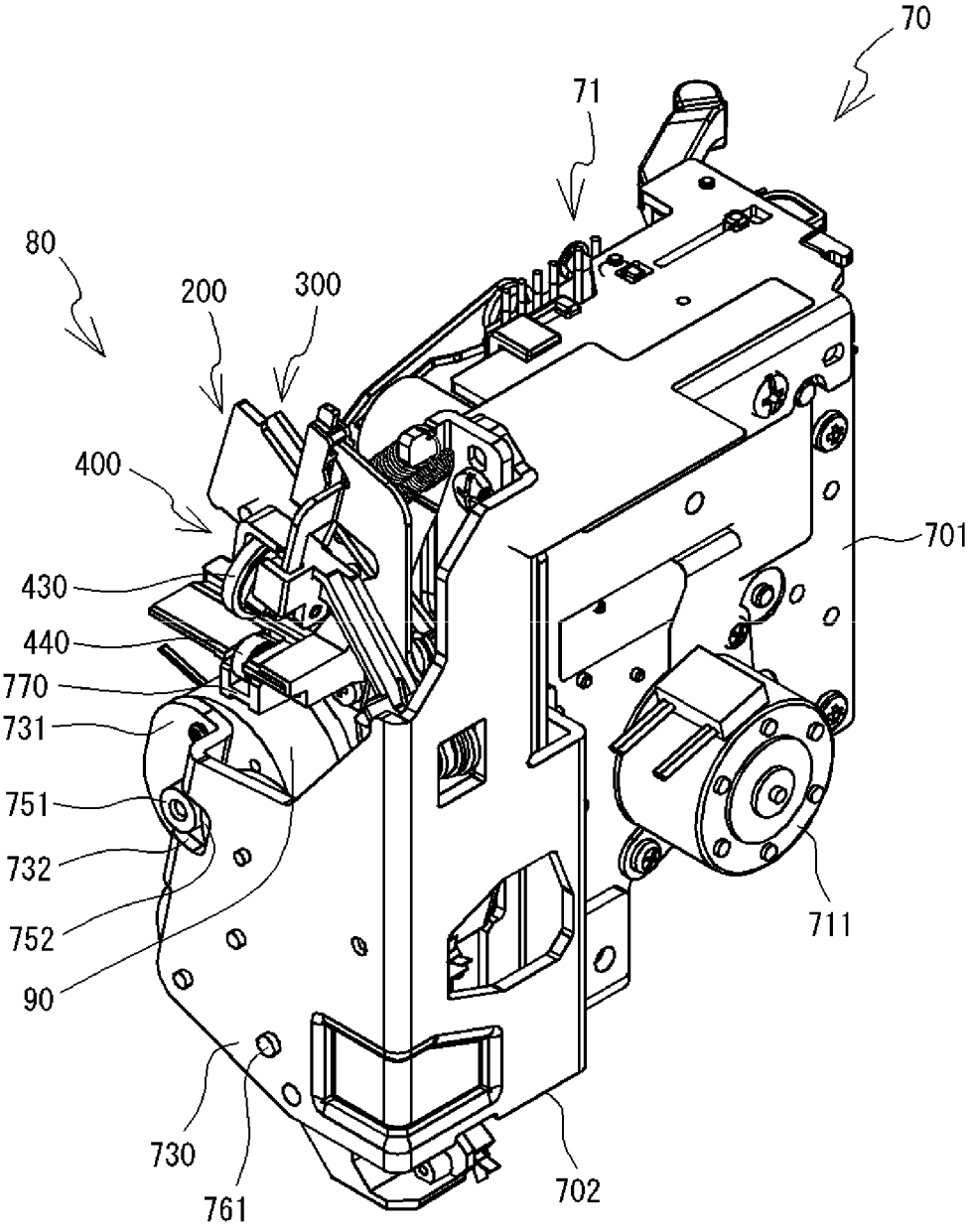
FIG. 4 is a perspective view showing the print formation unit diagonally from below.

A print formation unit 70 will now be described with reference to FIG. 3 and FIG. 4. The upper right side, lower left side, lower right side, upper left side, upper side, and lower side in FIG. 3 correspond to the front side, rear side, left side, right side, upper side, and lower side of the tape printer 1 shown in FIG. 1 and FIG. 2. In FIG. 3 and FIG. 4, the exterior finish of the platen holder 12 shown in FIG. 2 is omitted. In FIG. 4, a control portion 20 is omitted.

The unit 70 comprises a first frame 701, a second frame 702, a printing mechanism 71, a cutting mechanism 80, and the like. The first frame 701 is a plate-shaped metal frame that extends to the front, back, left, and right, and is disposed on the lower side of the cassette mounting part 8 (refer to FIG. 1). The printing mechanism 71 is disposed on the first frame 701. The printing mechanism 71 is a mechanism for printing characters on a tape using the tape cassette 30 mounted to the cassette mounting part 8.

The printing mechanism 71 includes the head holder 74, the thermal head 10 (refer to FIG. 2), the platen holder 12, the platen roller 15, the movable feeding roller 14, the ribbon take-up shaft 95, the tape driving shaft 100, the tape driving motor 711, gears 715-723, and the like. The lower end of the shaft support part 121 of the platen holder 12 supports the right front part of the first frame 701.

The tape driving motor 711 and the control portion 20 are disposed on the lower side of the first frame 701. A driving shaft 713 of the tape driving motor 711 protrudes to the upper side of the first frame 701 via a hole (not shown) disposed on the first frame 701. The gear 715 is fixed to the driving shaft 713 on the upper side of the first frame 701. The gear 715 meshes with the gear 716. The gear 717 meshes with the gear 716 and the gear 718. The gear 719 meshes with the gear 718, the gear 720, and the gear 721. The ribbon take-up shaft 95 stands on the upper surface of the gear 717. The tape driving shaft 100 stands on the upper surface of the gear 720.

The control portion 20 is an electric substrate comprising a CPU 162 (refer to FIG. 14 described later), a ROM, a RAM, and the like. The control portion 20 controls various movements of the tape printer 1 by having the CPU 162 execute programs stored in the ROM.

The second frame 702 is a plate-shaped metal frame that extends to the front, back, left, and right, and is screwed onto the left side of the first frame 701. The second frame 702 is disposed on the lower side of the tape discharging part 110 (refer to FIG. 1). The second frame 702 comprises a support plate 730 that extends upward from the left end of the second frame 702. The cutting mechanism 80 is disposed on the second frame 702. The cutting mechanism 80 is a mechanism for cutting the tape with print at a predetermined length. An attaching plate 731 that extends from the support plate 730 to the right side is disposed on the upper end of the support plate 730. The cutter driving motor 90 described later is fixed to the right surface of the attaching plate 731.

A movement overview of the tape printer 1 will now be described with reference to FIG. 2. In the example shown in FIG. 2, the tape cassette 30 of a receptor type is mounted to the cassette mounting part 8. In this case, when the platen holder 12 moves toward the print position, the platen roller 15 presses the thermal head 10 via the print-receiving tape 57 and the ink ribbon 60. Simultaneously, the movable feeding roller 14 presses the tape driving roller 46 via the print-receiving tape 57.

The control portion 20 (refer to FIG. 3) drives the tape driving motor 711 (refer to FIG. 4) during the execution of the printing movement. When the tape driving motor 711 is driven, the ribbon take-up shaft 95, the tape driving shaft 100, the movable feeding roller 14, and the platen roller 15 rotate via the gears 715-723 (refer to FIG. 3).

The ribbon take-up shaft 95 rotates the ribbon take-up spool 44, thereby pulling out the unused ink ribbon 60 from the ribbon spool 42. The tape driving shaft 100 rotates the tape driving roller 46, thereby feeding the print-receiving tape 57 sandwiched between the tape driving roller 46 and the movable feeding roller 14, pulling out the unused print-receiving tape 57 from the first tape spool 40. Between the platen roller 15 and the thermal head 10, the thermal head 10 performs printing on the print layer of the unused print-receiving tape 57 using the unused ink ribbon 60. The print-receiving tape 57 with print is fed to the tape discharging part 110 and cut by the cutting mechanism 80 (refer to FIG. 3) as described later. The cut print-receiving tape 57 is discharged from the discharging exit 111.

Figure 6:
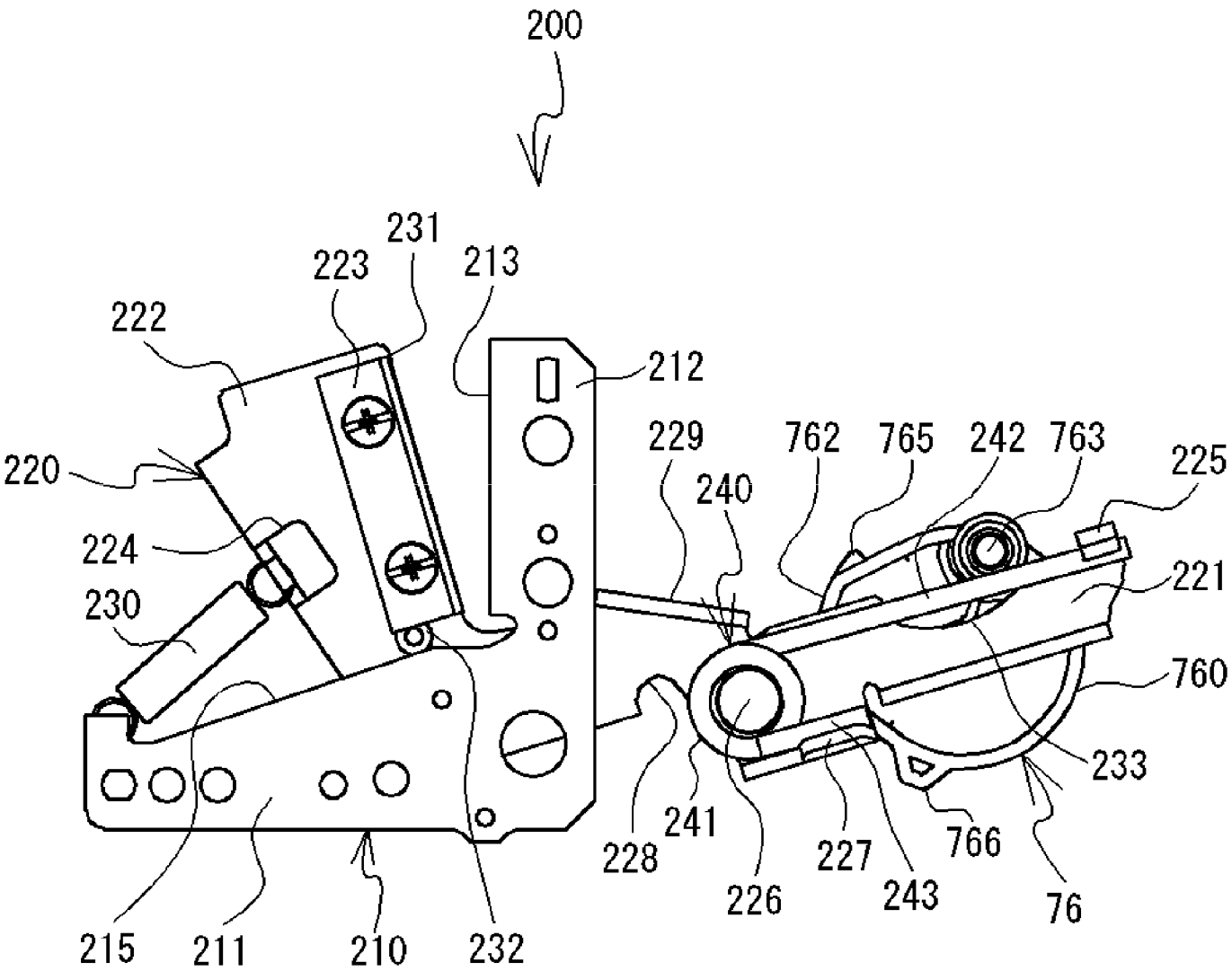
FIG. 6 is a front view of the half-cutting mechanism with the cam plate in the reference position.
Figure 7:
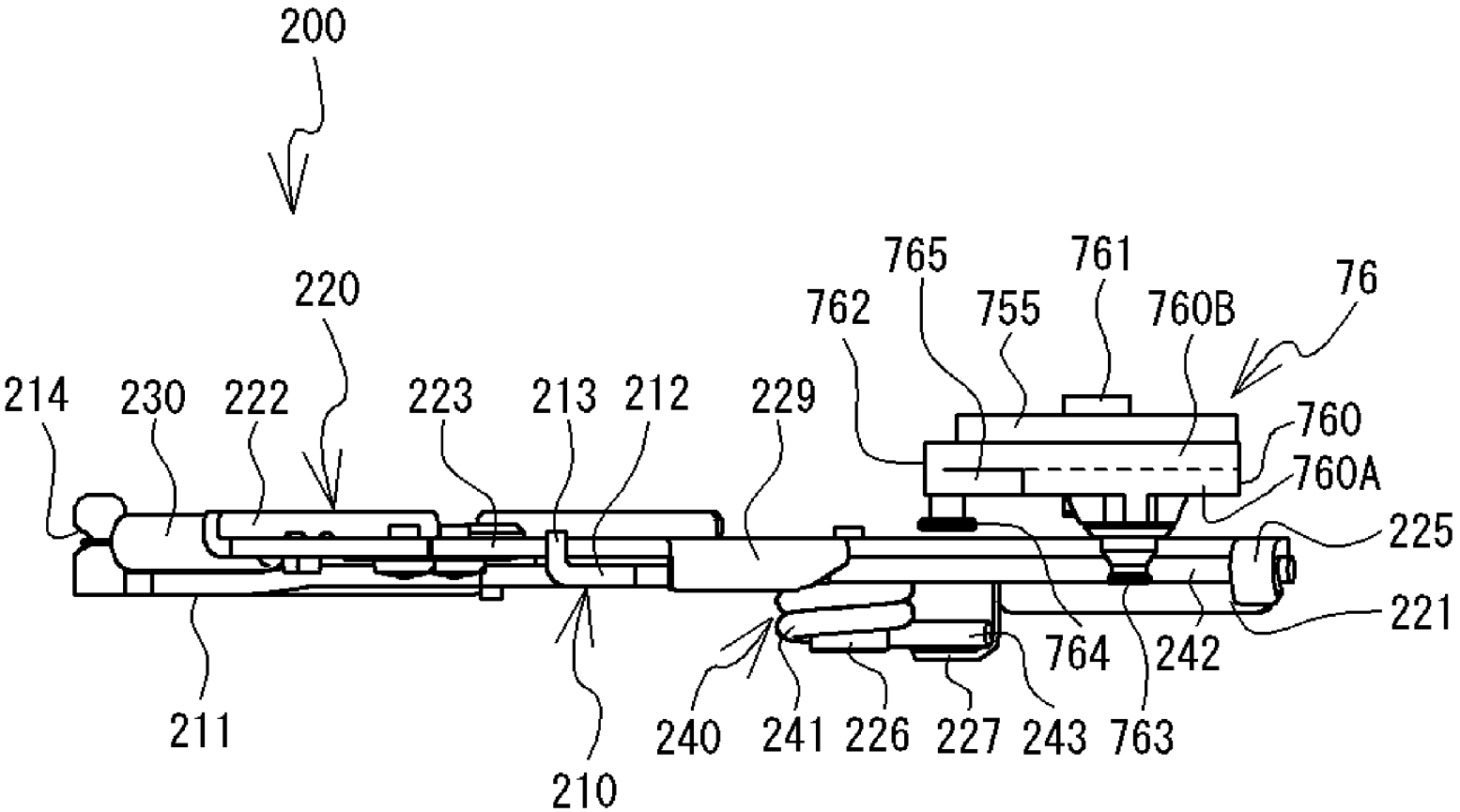
FIG. 7 is a plan view of the half-cutting mechanism with the cam plate in the reference position.
Figure 8:
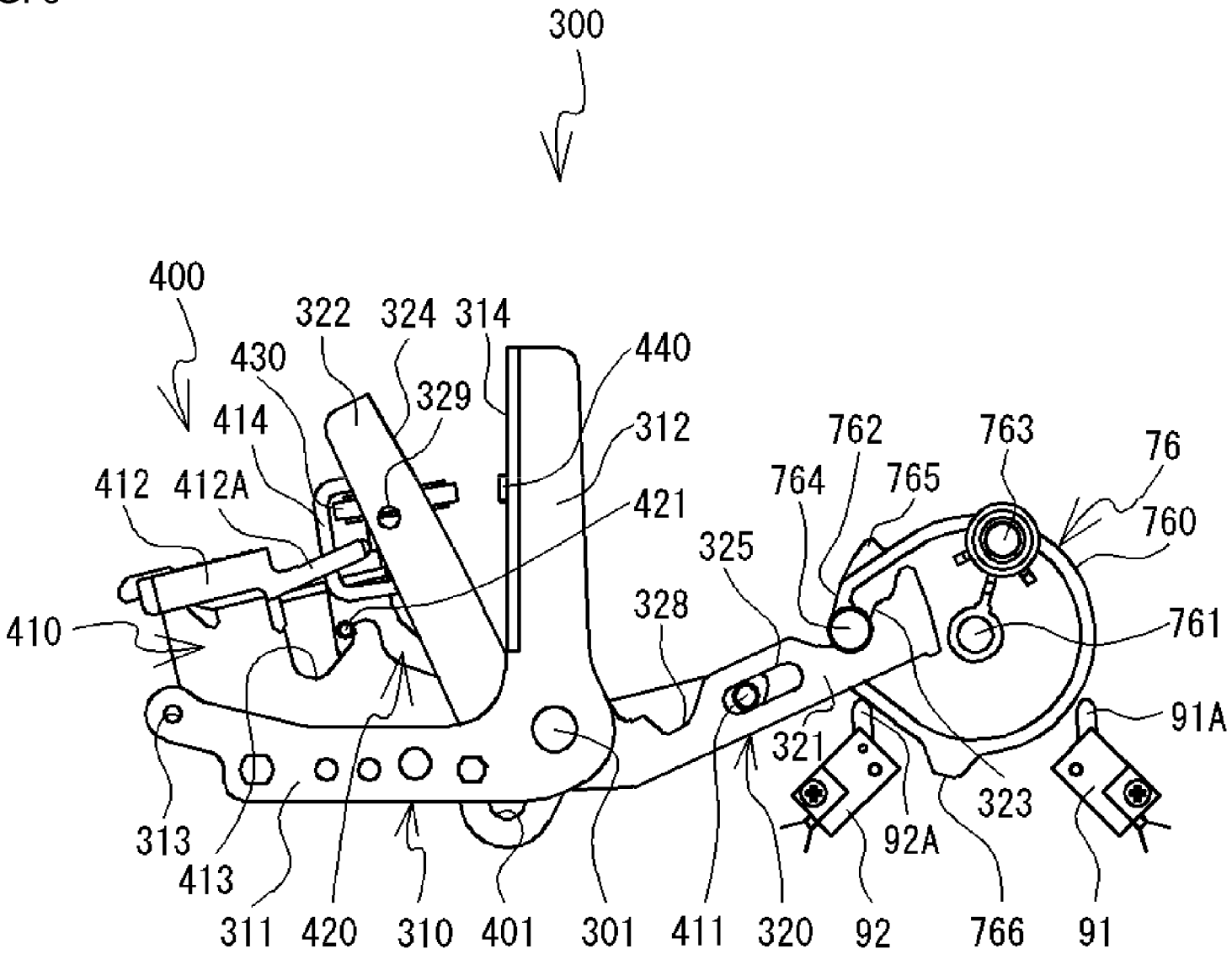
FIG. 8 is a front view of the full-cutting mechanism and the feeding mechanism with the cam plate in the reference position.

The following describes the cutting mechanism 80 with reference to FIGS. 3-13. In the following descriptions, the upper left side, the lower right side, the upper right side, the lower left side, the upper side, and the lower side in FIG. 3 conveniently refer to the front side, the rear side, the left side, the right side, the upper side, and the lower side of the cutting mechanism 80, respectively. For ease of understanding, in FIG. 8 and FIG. 9, a tension spring 33 is removed from a full-cutting mechanism 300. FIG. 8 shows a first detection sensor 91 and a second detection sensor 92 along with a cam plate 760.

Cutting Mechanism 80

Figure 5:
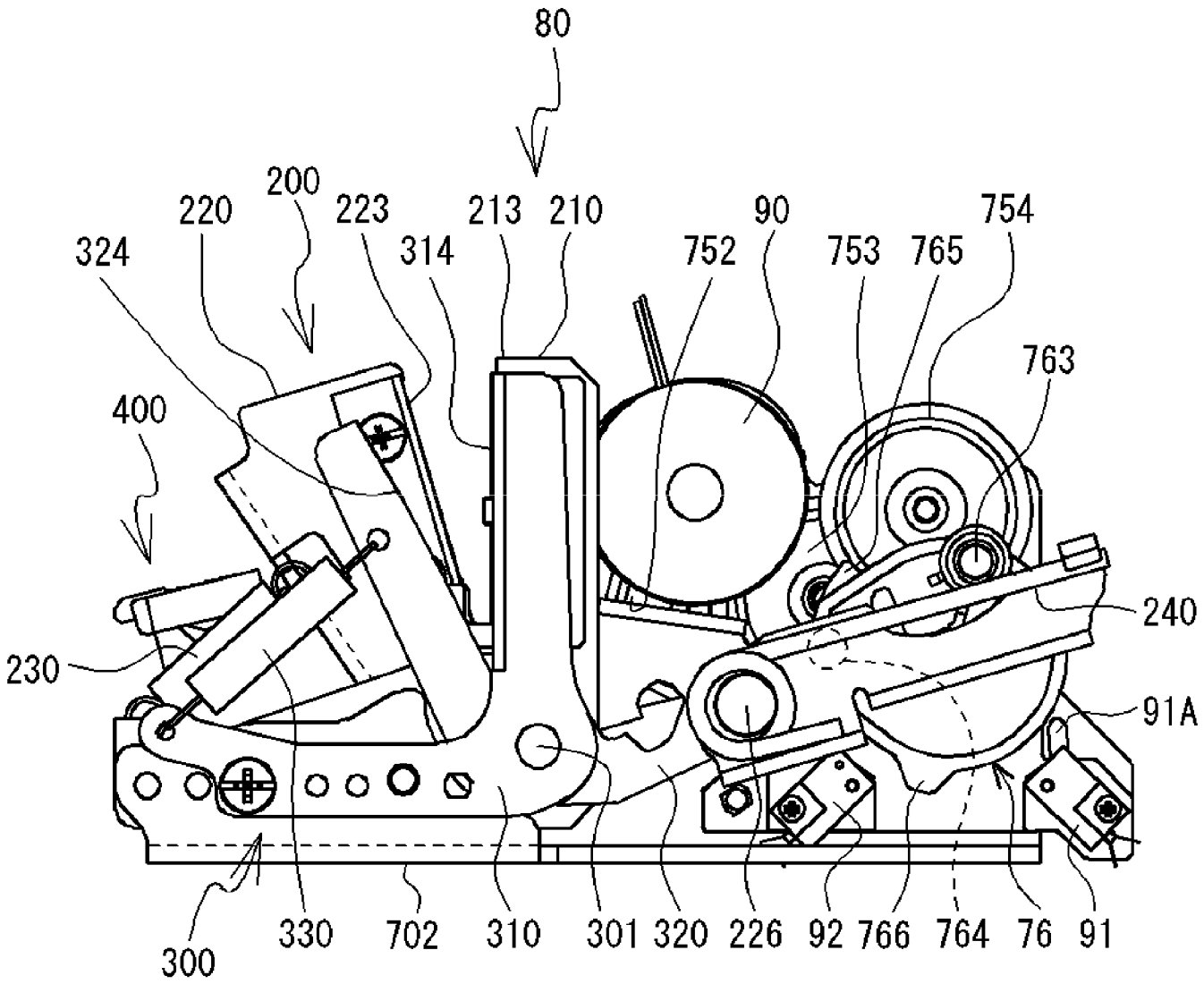
FIG. 5 is a front view of the cutting mechanism in a standby state.

As shown in FIGS. 3-5, the cutting mechanism 80 includes a half-cutting mechanism 200, the full-cutting mechanism 300, a feeding mechanism 400, the cutter driving motor 90, gears 751-755, a driving cam 76, and the like. In the interior of the tape discharging part 110 (refer to FIG. 1), the full-cutting mechanism 300, the half-cutting mechanism 200, and the feeding mechanism 400 are disposed along the tape feeding path. The full-cutting mechanism 300 is disposed on the rear side of the cassette mounting part 8. The feeding mechanism 400 is disposed on the front side of the discharging exit 111. The half-cutting mechanism 200 is disposed between the full-cutting mechanism 300 and the feeding mechanism 400.

The gear 751 attached to a driving shaft (not shown) of the cutter driving motor 90 is disposed inside a hole part 732 through which the attaching plate 731 is passed. The gears 752-755 are each rotatable around a shaft part that extends frontward from the attaching plate 731. The gear 752 meshes with the gear 751. The gear 753 meshes with the gear 752. The gear 754 meshes with the gear 753. The gear 755 meshes with the gear 754.

Surrounding Area of Driving Cam 76

As shown in FIGS. 5-9, the driving cam 76 includes the gear 755, the cam plate 760, and a shaft part 761. The cam plate 760 is in the shape of a disk larger than the gear 755, and fixed to the front side of the gear 755. The gear 755 and the cam plate 760 are integrally rotatable around the shaft part 761 that extends in the front-rear direction. The cam plate 760, excluding a protrusion part 762, is substantially equidistant from the shaft part 761 to the circumferential surface (that is, in radius). The protrusion part 762 is an area of the cam plate 760 that protrudes to the radial direction outside.

As shown in FIG. 6 and FIG. 8, a first driving pin 763, a second driving pin 764, a first detection plate 765, and a second detection plate 766 are disposed on the cam plate 760. The first driving pin 763 and the second driving pin 764 are both cylindrical units, protruding from the cam plate 760 to the front side. Specifically, the second driving pin 764 protrudes from the protrusion part 762 to the front side. The first driving pin 763 protrudes from the outer edge of the cam plate 760, unlike the protrusion part 762, to the front side. The first driving pin 763 is disposed in a position rotated substantially 90 degrees around the shaft part 761 in the clockwise direction in the front view, with respect to the second driving pin 764. The first driving pin 763 extends further on the front side than the second driving pin 764 (refer to FIG. 8 and FIG. 9).

Figure 9:
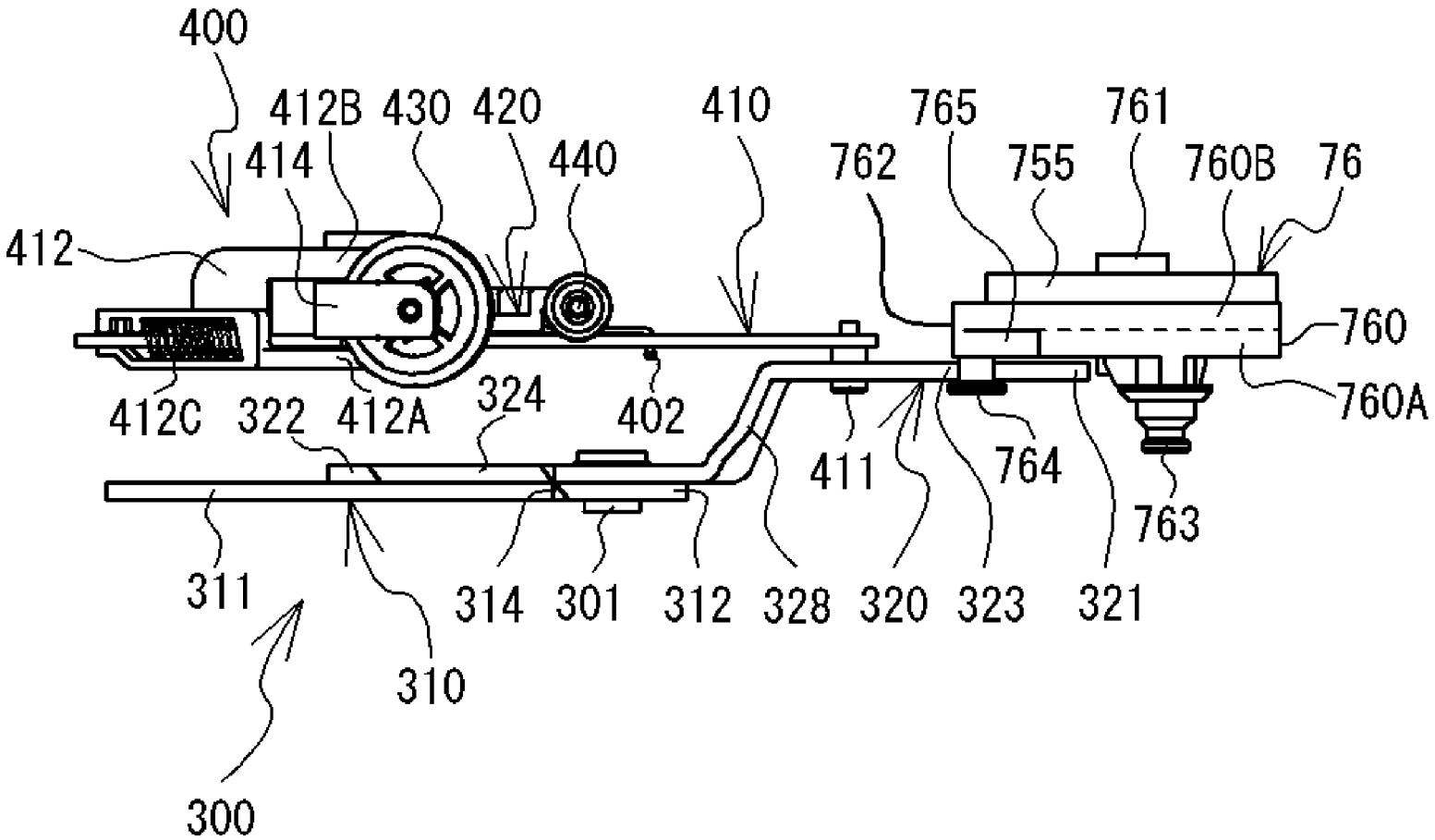
FIG. 9 is a plan view of the full-cutting mechanism and the feeding mechanism with the cam plate in the reference position.

As shown in FIG. 7 and FIG. 9, the circumferential surface of the cam plate 760 includes a front circumferential surface 760A, which is a circumferential surface further on the front side than the front-rear direction substantial center of the cam plate 760, and a rear circumferential surface 760B, which is a circumferential surface further on the rear side than the front-rear direction substantial center of the cam plate 760. The first detection plate 765 and the second detection plate 766 are both plate-shaped units that protrude from the front circumferential surface 760A to the radial direction outside.

Specifically, the first detection plate 765 is arc-shaped in the front view, extending in the clockwise direction around the shaft part 761 from the protrusion part 762. The second detection plate 766 is trapezoidal in shape in the front view, protruding from the circumferential surface of the cam plate 760, which differs from the circumferential surface of the protrusion part 762, to the radial direction outside. The second detection plate 766 is disposed on the side opposite the first driving pin 763, sandwiching the shaft part 761, in the front view. The protruding end of the first detection plate 765 and the protruding end of the second detection plate 766 are both equidistant from the shaft part 761.

Detection Sensors 91, 92

As shown in FIG. 5 and FIG. 8, the two first and second detection sensors 91, 92 are disposed on the lower side of the cam plate 760. The first detection sensor 91 is a mechanical sensor comprising a movable pin 91A, disposed downward from the right end of the cam plate 760. The movable pin 91A extends upward from the rotating shaft (not shown) toward the front circumferential surface 760A, which extends in the front-rear direction. If the movable pin 91A is in a stationary state that extends upward, the first detection sensor 91 outputs an OFF signal. When the movable pin 91A rotates in the clockwise direction in the front view, the movable pin 91A changes to an inclined state. If the movable pin 91A is in an inclined state, the first detection sensor 91 outputs an ON signal (hereinafter suitably referred to as "ON").

The second detection sensor 92 is a mechanical sensor comprising a movable pin 92A, disposed downward from the left end of the cam plate 760. The movable pin 92A extends upward from the rotating shaft (not shown) toward the rear circumferential surface 760B, which extends in the front-back direction. If the movable pin 92A is in a stationary state that extends upward, the second detection sensor 92 outputs an OFF signal. If the movable pin 92A rotates in the counter-clockwise direction in the front view from the stationary state, the movable pin 92A changes to an inclined state. If the movable pin 92A is in an inclined state, the second detection sensor 92 outputs an ON signal.

Half-Cutting Mechanism 200

The half-cutting mechanism 200 will now be described with reference to FIG. 6 and FIG. 7. The half-cutting mechanism 200 is a mechanism for cutting only a portion of the layers (that is, for partially cutting in the thickness direction) of a tape in which a plurality of layers is layered. The half-cutting mechanism 200 includes a fixed part 210, a movable part 220, a tension spring 230, and a pressing spring 240.

The fixed part 210 is a plate-shaped member substantially L-shaped in the front view, and includes a first plate part 211, a second plate part 212, and a receiving tray 213. The first plate part 211 is a plate-shaped part that extends in the left-right direction, and is fixed to the second frame 702 (refer to FIGS. 3-5). The second plate part 212 is a plate-shaped part that extends in the upper direction from the right end of the first plate part 211. The receiving tray 213 is a surface part parallel in the front-rear direction and up-down direction, protruding rearward from the left side part of the second plate part 212. The receiving tray 213 is rectangular in shape, long in the up-down direction and short in the front-rear direction. An upper side part 215 of the first plate part 211 inclines in the upper right direction from the left end of the first plate part 211 toward the lower end of the receiving tray 213.

The movable part 220 is a plate-shaped member substantially L-shaped in the front view, and includes a first plate part 221, a second plate part 222, a cutting blade 223, and the like. The movable part 220 is disposed overlapping the back surface of the fixed part 210, on the front side of the cam plate 760. The first plate part 221 is a plate-shaped part that extends in the substantial left-right direction, extending from the back surface of the fixed part 210 to the right side of the cam plate 760. The second plate part 222 is a plate-shaped part that extends from the left end of the first plate part 221 to the upper side, inclining substantially 90 degree with respect to the first plate part 221. The cutting blade 223 is a blade part that extends along the right side part of the second plate part 222 and faces the receiving tray 213 from the left side.

Locking plates 225, 227, 229, spring shaft part 226, escape groove 228, and guide groove 233 are disposed on the first plate part 221. The spring shaft part 226 extends frontward from the first plate part 221, between the second plate part 212 and the cam plate 760 in the front view. The locking plates 225, 227, 229 are all protruding pieces that protrude frontward from the first plate part 221. The locking plate 225 protrudes frontward from the upper right end of the first plate part 221. The locking plate 227 protrudes frontward from the lower side of the spring shaft part 226. The locking plate 229 protrudes frontward from the upper side of the spring shaft part 226 and the right side of the second plate part 212. The escape groove 228 is a groove part that is indented upward from the lower side part of the first plate part 221, disposed between the second plate part 212 and the spring shaft part 226 in the front view.

The pressing spring 240 is a torsion coil spring held by the first plate part 221, and includes a coil part 241 and a pair of arm parts 242, 243. The pair of arm parts 242, 243 extends in the same direction from both ends of the coil part 241. The rear-side arm part 242 has a larger protruding width from the coil part 241 than the front-side arm part 243. With the pressing spring 240 attached to the first plate part 221, the spring shaft part 226 is inserted through a shaft hole in the coil part 241. A tip end of the arm part 242 is locked in the locking plate 225 by urging the locking plate 225 from the lower side. A tip end of the arm part 243 is locked in the locking plate 227 by urging the locking plate 227 from the upper side.

The guide groove 233 is a groove part that is indented downward from the upper side part of the first plate part 221, disposed on the lower side of the first driving pin 763 in the front view. The guide groove 233 is indented in an arc shape in the front view, to an area further on the lower side than the arm part 242 locked in the locking plate 225.

A gap forming part 231 and a support pin 232 are disposed on the second plate part 222. The gap forming part 231 protrudes from the upper side of the cutting blade 223 slightly further toward the receiving tray 213 than the cutting blade 223. The support pin 232 is a shaft body that extends frontward from the second plate part 222, disposed on the lower side of the cutting blade 223. The support pin 232 is placed on the upper side part 215, and is slidable along the upper side part 215. The movable part 220 is supported overlapping the second plate part 212 by the support pin 232.

One end of the tension spring 230 is connected to an attaching hole 224 disposed on the second plate part 222. The other end of the tension spring 230 is connected to an attaching hole 214 disposed on the left end of the first plate part 211. The second plate part 222 is urged to the left side by the elastic force of the tension spring 230. Accordingly, without an external force applied to the movable part 220, the movable part 220 moves to the left side while guided by the support pin 232 that slides along the upper side part 215. When the locking plate 229 is locked in the second plate part 212, the left-side movement of the movable part 220 is regulated. With this arrangement, the movable part 220 is held in a retracted position with the cutting blade 223 away from the receiving tray 213.

Full-Cutting Mechanism 300

The full-cutting mechanism 300 will now be described with reference to FIG. 8 and FIG. 9. The full-cutting mechanism 300 is a mechanism for cutting (fully cutting) all layers of a tape in which a plurality of layers is layered. The full-cutting mechanism 300 includes a fixed part 310, a movable part 320, and a tension spring 330.

The fixed part 310 is a plate-shaped member substantially L-shaped in the front view, and includes a first plate part 311, a second plate part 312, and a fixed blade 314. The first plate part 311 is a plate-shaped part that extends in the left-right direction, and is fixed to the second frame 702 (refer to FIGS. 3-5). The second plate part 312 is a plate-shaped part that extends in the upper direction from the right end of the first plate part 311. The fixed blade 314 is a blade part that extends in the up-down direction, disposed on the left side part of the second plate part 312.

The movable part 320 is a plate-shaped member substantially L-shaped in the front view, and includes a first plate part 321, a second plate part 322, a movable blade 324, and the like. The movable part 320 is disposed overlapping the back surface of the fixed part 310, on the front side of the cam plate 760. The first plate part 321 is a plate-shaped part that extends in the substantial left-right direction, extending from the back surface of the fixed part 310 to the front side of the cam plate 760. The second plate part 322 is a plate-shaped part that extends from the left end of the first plate part 321 to the upper side, inclining substantially 90 degree with respect to the first plate part 321. The movable blade 324 is a blade part that extends along the right side part of the second plate part 322 and faces the fixed blade 314 from the left side.

A support hole (not shown) that passes through the fixed part 310 is disposed in an area where the first plate part 311 and the second plate part 312 connect. A support hole (not shown) that passes through the movable part 320 is disposed in an area where the first plate part 321 and the second plate part 322 connect. A rotating shaft 301 that extends in the front-rear direction is inserted through each of the support holes in the fixed part 310 and the movable part 320. That is, the rotating shaft 301 rotatably supports the fixed part 310 and the movable part 320, with the two overlapping each other.

A guide groove 323, a guide hole 325, and an escape groove 328 are disposed on the first plate part 321. The guide groove 323 is a groove part that is indented downward from the upper side part of the first plate part 321, disposed on the tip end side of the first plate part 321. The guide hole 325 is a hole that passes through the first plate part 321, disposed in the longitudinal direction substantial center of the first plate part 321. The guide hole 325 is a long hole that extends parallel to the longitudinal direction of the first plate part 321. The area near the left end of the first plate part 321 inclines frontward toward the back surface of the fixed part 310 (refer to FIG. 9), and includes the escape groove 328. The escape groove 328 is a groove part that is indented downward from the upper side part of the first plate part 321.

One end of the tension spring 330 (refer to FIG. 5) is connected to an attaching hole 313 disposed on the left end of the first plate part 311. The other end of the tension spring 330 is connected to an attaching hole 329 disposed on the second plate part 322. The second plate part 322 is urged to the left side by the elastic force of the tension spring 330. Accordingly, without an external force applied to the movable part 320, the movable part 320 rotates around the rotating shaft 301 in the counterclockwise direction in the front view. With this arrangement, the movable part 320 is held in a retracted position with the movable blade 324 away from the fixed blade 314.

Feeding Mechanism 400

The feeding mechanism 400 will now be described with reference to FIG. 8, FIG. 9, and FIG. 13. The feeding mechanism 400 is a mechanism for feeding a tape cut by the full-cutting mechanism 300 toward the discharging exit 111 (refer to FIG. 1). The feeding mechanism 400 includes a first link 410, a second link 420, a movable roller 430, a fixed roller 440, and the like.

A guide member 770 (refer to FIG. 3 and FIG. 4) is disposed along the feeding path of the tape in the tape discharging part 110 (refer to FIG. 1). The guide member 770 stands on the second frame 702 (refer to FIG. 3 and FIG. 4) and comprises a guide surface that guides the tape with print fed by the tape discharging part 110 toward the discharging exit 111. The fixed roller 440 is a rotating body capable of rotating around an axis that extends in the up-down direction, disposed on the guide member 770.

The fixed roller 440 is disposed rearward from the fixed blade 314. A rotating shaft 401 that supports the first link 410 and the second link 420 side-by-side in the front-rear direction is disposed downward from the fixed roller 440. The rotating shaft 401 is a shaft part that extends in the front-rear direction, disposed on the guide member 770.

The first link 410 is a plate-shaped member long in the substantial left-right direction, disposed on the rear side of the movable part 320, and is rotatable around the rotating shaft 401 on the front side of the second link 420. The first link 410 extends in the right direction from the rotating shaft 401, and to the rear side of the guide hole 325. A locking pin 411 that protrudes frontward from the first link 410 is disposed on the right end of the first link 410. The locking pin 411 is inserted through the guide hole 325. The first link 410 extends in the upper left direction from the rotating shaft 401, and to the left side of the movable roller 430. An operation mechanism 412 that rotates the movable roller 430 is disposed on the upper left end of the first link 410.

The second link 420 is a plate-shaped member rotatable around the rotating shaft 401 on the rear side of the first link 410, and extends in the upper left direction from the rotating shaft 401. The second link 420 is connected to the first link 410 via a connecting spring 402 disposed on the rotating shaft 401. A roller holder 414 that rotationally supports a movable roller 430, which is a rotating body, is disposed on the upper left end of the rotating shaft 401. The roller holder 414 is disposed on the right side of the operation mechanism 412. The movable roller 430 faces the fixed roller 440 from the left side.

The structure and action of the operation mechanism 412 and the roller holder 414 are known as described in JP, A, 2000-71523, for example, and will therefore be generally described. The roller holder 414 comprises a spring (not shown) that urges the movable roller 430 toward the right side. The operation mechanism 412 comprises a roller pressing member 412A, a hook member 412B, a spring 412C, and the like.

The roller pressing member 412A is a movable body movable in the substantial left-right direction, disposed on the front side of the movable roller 430 in the planar view. The spring 412C urges the roller pressing member 412A toward the movable roller 430. The roller pressing member 412A presses a first protrusion part (not shown) disposed on the movable roller 430 by the elastic force of the spring 412C. The hook member 412B is disposed on the rear side of the movable roller 430 in the planar view, and contacts a second protrusion part (not shown) disposed on the movable roller 430.

As movable part 320 of the full-cutting mechanism 300 rotates, the locking pin 411 moves along the guide hole 325. As the locking pin 411 moves, the first link 410 rotates around the rotating shaft 301. As the first link 410 rotates, the second link 420 also rotates via the connecting spring 402. As shown in FIG. 8 and FIG. 9, when the movable part 320 of the full-cutting mechanism 300 moves toward the retracted position, the locking pin 411 moves toward the left end of the guide hole 325. The first link 410 and the second link 420 rotate in the counterclockwise direction in the front view. With this arrangement, the second link 420 is held in the retracted position with the movable roller 430 away from the fixed roller 440.

Connecting Structure of Cutting Mechanism 80

The following describes the connecting structure of the cutting mechanism 80 with reference to FIGS. 5-9. As shown in FIG. 5, the movable part 220 of the half-cutting mechanism 200 extends in the left-right direction across the escape groove 328 (refer to FIG. 8) of the movable part 320 of the full-cutting mechanism 300. The escape groove 228 (refer to FIG. 6) of the half-cutting mechanism 200 faces the escape groove 328 from the upper side.

As shown in FIG. 5, FIG. 7, and FIG. 9, in the left-side section of the cutting mechanism 80, the fixed blade 314 of the full-cutting mechanism 300, the receiving tray 213 of the half-cutting mechanism 200, and the fixed roller 440 of the feeding mechanism 400 are aligned in that order from the front side toward the rear. The movable blade 324 of the full-cutting mechanism 300, the cutting blade 223 of the half-cutting mechanism 200, and the movable roller 430 of the feeding mechanism 400 are aligned from the front side toward the rear.

In a case where the cutter driving motor 90 is not driven, the cutting mechanism 80 is in a standby state (refer to FIGS. 5-9). In the cutting mechanism 80 in the standby state, the movable parts 220, 320 and the second link 420 are all in retracted positions. The gap between the fixed blade 314 and the movable blade 324, the gap between the receiving tray 213 and the cutting blade 223, and the gap between the fixed roller 440 and the movable roller 430 are communicated with each other in the front-rear direction. The feeding path of the tape of the tape discharging part 110 (refer to FIG. 1) passes through these gaps communicated in the front-rear direction. The tape with print is fed along the fixed blade 314, the receiving tray 213, and the fixed roller 440.

In the right-side section of the cutting mechanism 80, the first plate part 221 of the half-cutting mechanism 200 is disposed on the front side of the first plate part 321 of the full-cutting mechanism 300, and extends further on the right side than the first plate part 321. The locking pin 411 of the feeding mechanism 400 is connected to the guide hole 325 of the full-cutting mechanism 300 further on the left side than the drive cam 76.

As shown in FIG. 5, FIG. 6, and FIG. 8, if the cutting mechanism 80 is in the standby state, the rotating position of the cam plate 760 is in a reference position where the protrusion part 762 faces the left side. If the cam plate 760 is in the reference position, the first driving pin 763 is positioned upward from the shaft part 761. The second driving pin 764 is positioned leftward from the shaft part 761.

As shown in FIG. 6 and FIG. 7, the first driving pin 763 extends frontward to the upper side of the first plate part 221 of the half-cutting mechanism 200. If the cutting mechanism 80 is in the standby state, the first driving pin 763 contacts the arm part 242 of the pressing spring 240 locked in the locking plate 225 from the upper side. As shown in FIG. 8 and FIG. 9, the second driving pin 764 extends frontward to the upper side of the first plate part 321 of the full-cutting mechanism 300. If the cutting mechanism 80 is in the standby state, the second driving pin 764 contacts the guide groove 323 of the first plate part 321 from the upper side.

Operation Mode of Cutting Mechanism 80

The following describes the operation mode of the cutting mechanism 80 with reference to FIGS. 5-13. The following description illustrates a case where the print-receiving tape 57 with print (refer to FIG. 2) is cut. The cutting mechanism 80 starts a cutting movement from a standby state (refer to FIGS. 5-9). As shown in FIG. 8, in the cam plate 760 in the reference position, the movable pin 91A is away from the first detection plate 765 and the second detection plate 766. The movable pin 91A is in a stationary state, and therefore the first detection sensor 91 is OFF. The movable pin 92A is away from the protrusion part 762. The movable pin 92A is in a stationary state, and therefore the second detection sensor 92 is OFF.

Operation Mode of Half-Cutting Mechanism 200

Figure 10:
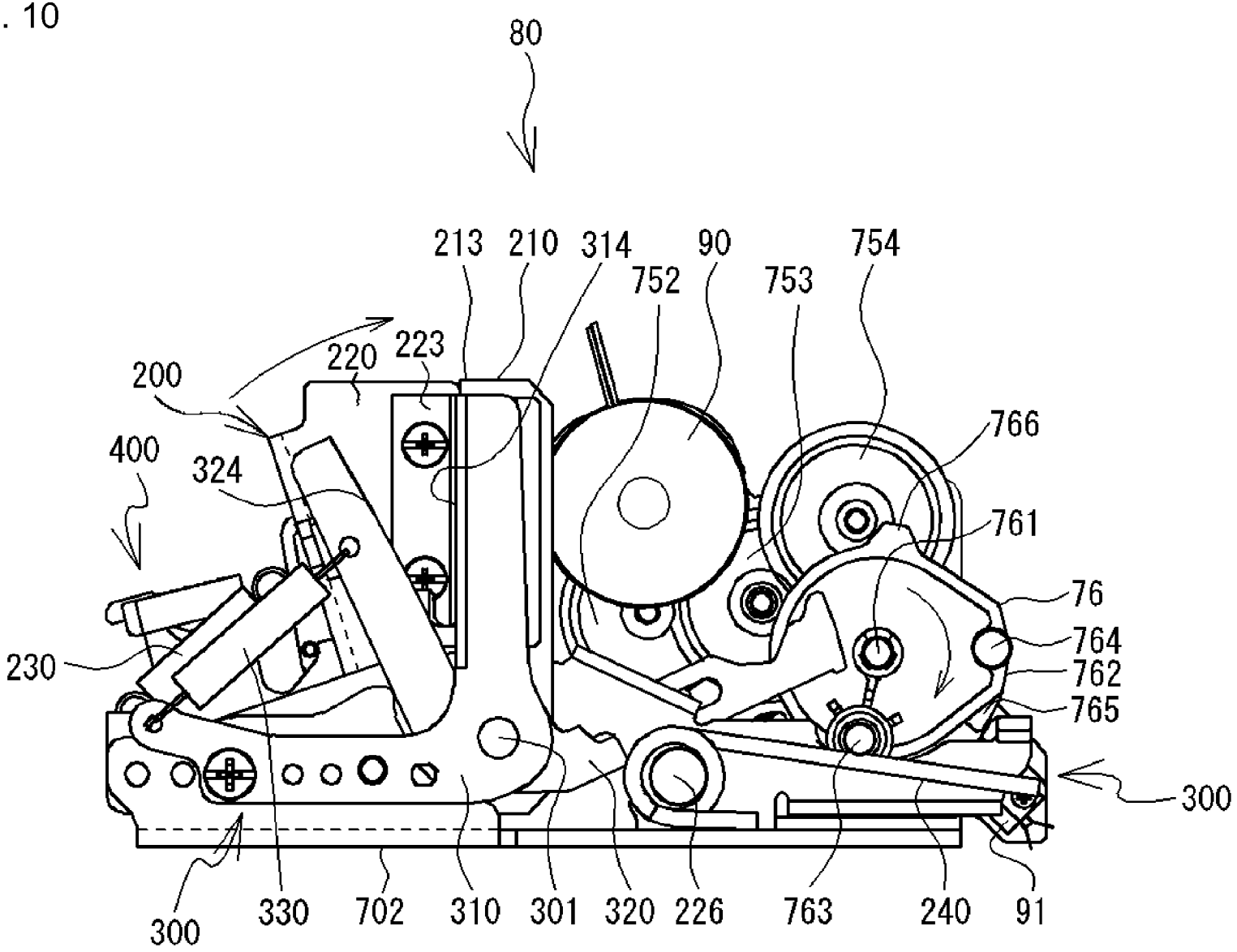
FIG. 10 is a front view of the cutting mechanism with the cam plate in the first displacement position.
Figure 11:
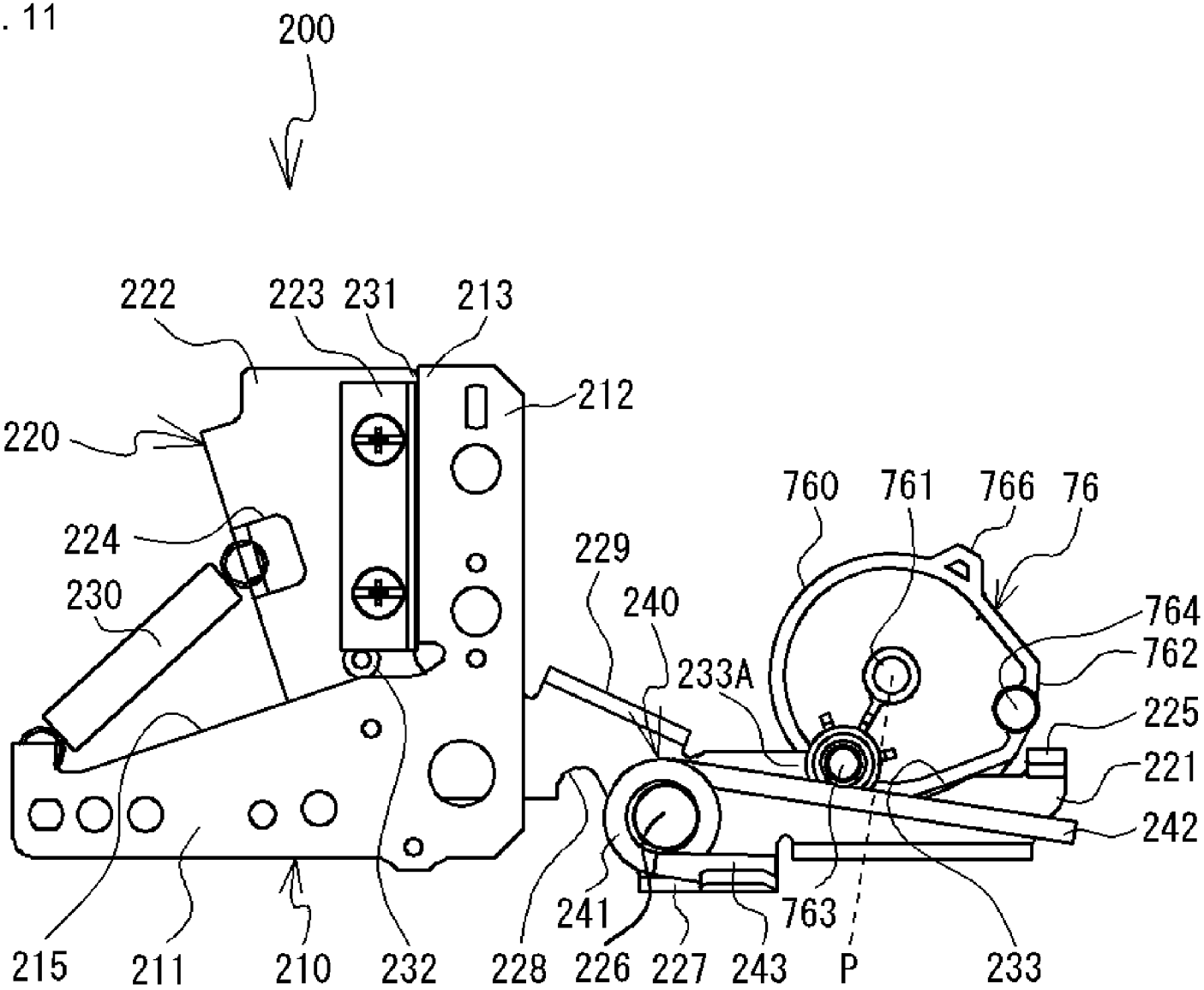
FIG. 11 is a front view of the half-cutting mechanism with the cam plate in the first displacement position.

The following describes the operation mode of the half-cutting mechanism 200. As shown in FIG. 10 and FIG. 11, the control portion 20 (refer to FIG. 3) rotates the cutter driving motor 90 in the forward direction (hereinafter "forward") if the print-receiving tape 57 is to be cut by the half-cutting mechanism 200. When the cutter driving motor 90 rotates forward, the cam plate 760 rotates in the clockwise direction in the front view via the gears 751-755 (refer to FIGS. 3-5). As the cam plate 760 rotates, the first driving pin 763 rotates in a first operation direction. The first operation direction is the clockwise direction in the front view, with the shaft part 761 as the center.

The first driving pin 763 that rotates in the first operation direction urges the arm part 242 downward. The urged arm part 242 elastically deforms and is separated downward from the locking plate 225. The first driving pin 763 that urges the arm part 242 contacts the guide groove 233. The first driving pin 763 that rotates in the first operation direction urges the first plate part 221 downward while sliding from the right end toward the left end of the guide groove 233. As the first plate part 221 moves downward, an urging force that rotates the movable part 220 around the support pin 232 occurs. Due to this urging force, the support pin 232 resists the elastic force of the tension spring 230 and moves in the right direction along the upper side part 215. That is, the cutting blade 223 disposed on the second plate part 222 moves to the right side.

If the first plate part 221 moves downward as described above, the escape groove 228 of the first plate part 221 crosses and fits into the escape groove 328 (refer to FIG. 8) of the first plate part 321. Accordingly, the half-cutting mechanism 200 can execute the cutting movement of the partial cutting (half cutting) without interfering with the full-cutting mechanism 300.

As shown in FIG. 10, when the cam plate 760 rotates substantially 180 degrees in the first operation direction from the reference position, the movable part 220 moves from the retracted position to the cutting position. The cutting position is a position where the cutting blade 223 is near the receiving tray 213. If the movable part 220 is in the cutting position, the gap forming part 231 (refer to FIG. 11) contacts the receiving tray 213. A gap that is narrower than the thickness of the print-receiving tape 57 (specifically, a gap substantially equal to the thickness of the print layer) is formed between the cutting blade 223 and the receiving tray 213.

The rotating position of the cam plate 760 that moves the movable part 220 to the cutting position is referred to as a first displacement position. As the cam plate 760 rotates in the first operation direction from the reference position, the movable pin 91A (refer to FIG. 8) moves relatively along the front circumferential surface 760A (refer to FIG. 7). When the cam plate 760 rotates to the first displacement position, the first detection plate 765 contacts the movable pin 91A. The movable pin 91A changes from the stationary state to the inclined state, causing the first detection sensor 91 to change from OFF to ON.

As the cam plate 760 rotates from the reference position to the first displacement position, the movable pin 92A (refer to FIG. 8) passes behind the second detection plate 766, moving relatively along the rear circumferential surface 760B (refer to FIG. 7). The movable pin 92A does not contact the protrusion part 762, and thus the second detection sensor 92 (refer to FIG. 8) is held in the OFF state. Accordingly, if the first detection sensor 91 turns ON and the second detection sensor 92 turns OFF while the cutter driving motor 90 is rotating forward, the control portion 20 determines that the cam plate 760 has rotated to the first displacement position.

If the control portion 20 determines that the cam plate 760 has rotated to the first displacement position, the control portion 20 rotates the cutter driving motor 90 further forward by a predetermined amount, sliding the first driving pin 763 to the left end of the guide groove 233. The rotating position of the cam plate 760 that slides the first driving pin 763 to the left end of the guide groove 233 is referred to as a cam holding position. The control portion 20, after rotating the cutter driving motor 90 forward by a predetermined amount, stops the driving of the cutter driving motor 90 for a predetermined amount of time.

As shown in FIG. 11, as the cam plate 760 rotates from the first displacement position to the cam holding position, the first driving pin 763 slides in the left direction in the guide groove 233 while urging the first plate part 221 downward. As the first plate part 221 is urged downward, the cutting blade 223 presses the receiving tray 213 more strongly. When the first driving pin 763 moves by a predetermined amount in the guide groove 233, it contacts a wall part 233A that forms a left end of the guide groove 233. The wall part 233A contacts the first driving pin 763 from a direction (a second operation direction described later) opposite the first operation direction in which the first driving pin 763 rotates, regulating the sliding of the first driving pin 763 in the left direction.

The arm part 242 urges the first driving pin 763 that slides along the guide groove 233 toward the side opposite the arm part 243. The urging force of the arm part 242 is applied toward the upper side of the arm part 242, parallel to a vertical line P that extends from the first driving pin 763 to the arm part 242. The first driving pin 763 that is in contact with the wall part 233A is positioned further in the first operation direction than the vertical line P that extends from the first driving pin 763 to the arm part 242.

In this case, the urging force of the arm part 242 causes an action that rotates the first driving pin 763 in the first operation direction. The first driving pin 763 does not rotate in the first operation direction since the movement in the left direction is regulated by the wall part 233A. The arm part 242 urges the first driving pin 763 to the wall part 233A, thereby regulating the movement of the first driving pin 763 (that is, the rotation of the cam plate 760). Even if the driving of the cutter driving motor 90 is stopped, the first driving pin 763 is held at the left end of the guide groove 233.

With the above movement, the print-receiving tape 57 with print is partially cut as follows. As the cam plate 760 rotates from the reference position to the first displacement position, the cutting blade 223 moves near the receiving tray 213. The print-receiving tape 57 fed to the tape discharging part 110 (refer to FIG. 1) is pressed against the receiving tray 213 by the cutting blade 223. The print-receiving tape 57 is disposed in the gap between the cutting blade 223 and the receiving tray 213. While the cam plate 760 rotates from the first displacement position to the cam holding position, and is held in the cam holding position, the cutting blade 223 strongly urges the print-receiving tape 57 toward the receiving tray 213. A portion of the layers (specifically, the separation layer) of the print-receiving tape 57 is cut by the cutting blade 223. That is, the print-receiving tape 57 is partially cut (half cut).

Subsequently, the control portion 20 rotates the cutter driving motor 90 in the reverse direction (hereinafter "reverse"). When the cutter driving motor 90 rotates in reverse, the cam plate 760 rotates in the counterclockwise direction in the front view via the gears 751-755. As the cam plate 760 rotates, the first driving pin 763 rotates in the second operation direction. The second operation direction is the counterclockwise direction in the front view, with the shaft part 761 as the center. The first driving pin 763 resists the urging force of the arm part 242 and slides from the left end of the guide groove 233 toward the right end. That is, the cam plate 760 rotates from the cam holding position (refer to FIG. 11) to the first displacement position (refer to FIG. 10).

The control portion 20 rotates the cam plate 760 in the second operation direction until the first detection sensor 91 changes from ON to OFF (that is, until the first detection plate 765 separates from the movable pin 91A). If the first detection sensor 91 has changed from ON to OFF, the control portion 20 stops the driving of the cutter driving motor 90.

With this arrangement, the arm part 242 elastically moves so as to lift the first driving pin 763, and is locked into the locking plate 225. As the first driving pin 763 moves, the cam plate 760 rotates to the reference position. Due to the elastic force of the tension spring 230, the support pin 232 moves to the left side along the upper side part 215. Until the locking plate 229 contacts the second plate part 212, the movable part 220 moves to the left side. The movable part 220 moves from the cutting position to the retracted position.

With the above movement, the cutting mechanism 80 returns to the standby state. After the movable part 220 moves to the retracted position, the control portion 20 drives the tape driving motor 711 (refer to FIG. 4) by a predetermined amount. With this arrangement, the print-receiving tape 57 in which the separation layer has been cut is fed toward the discharging exit 111.

Operation Mode of Full-Cutting Mechanism 300 and Feeding Mechanism 400

The following describes the operation mode of the full-cutting mechanism 300 and the feeding mechanism 400. The control portion 20 rotates the cutter driving motor 90 in reverse, rotating the cam plate 760 in the second operation direction from the reference position if the print-receiving tape 57 is to be cut by the full-cutting mechanism 300.

Figure 12:
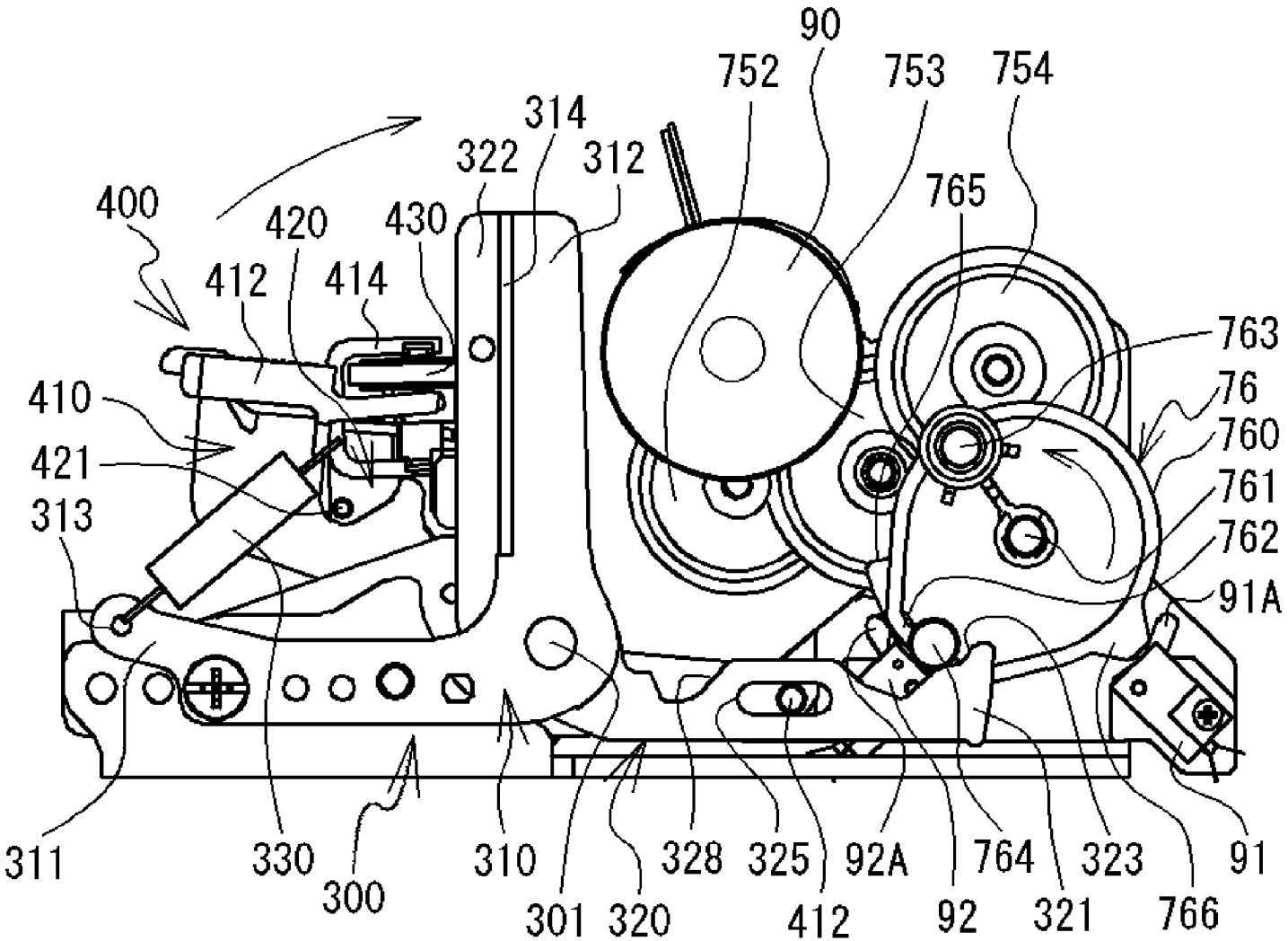
FIG. 12 is a front view of the full-cutting mechanism and the feeding mechanism with the cam plate in the second displacement position.
Figure 13:
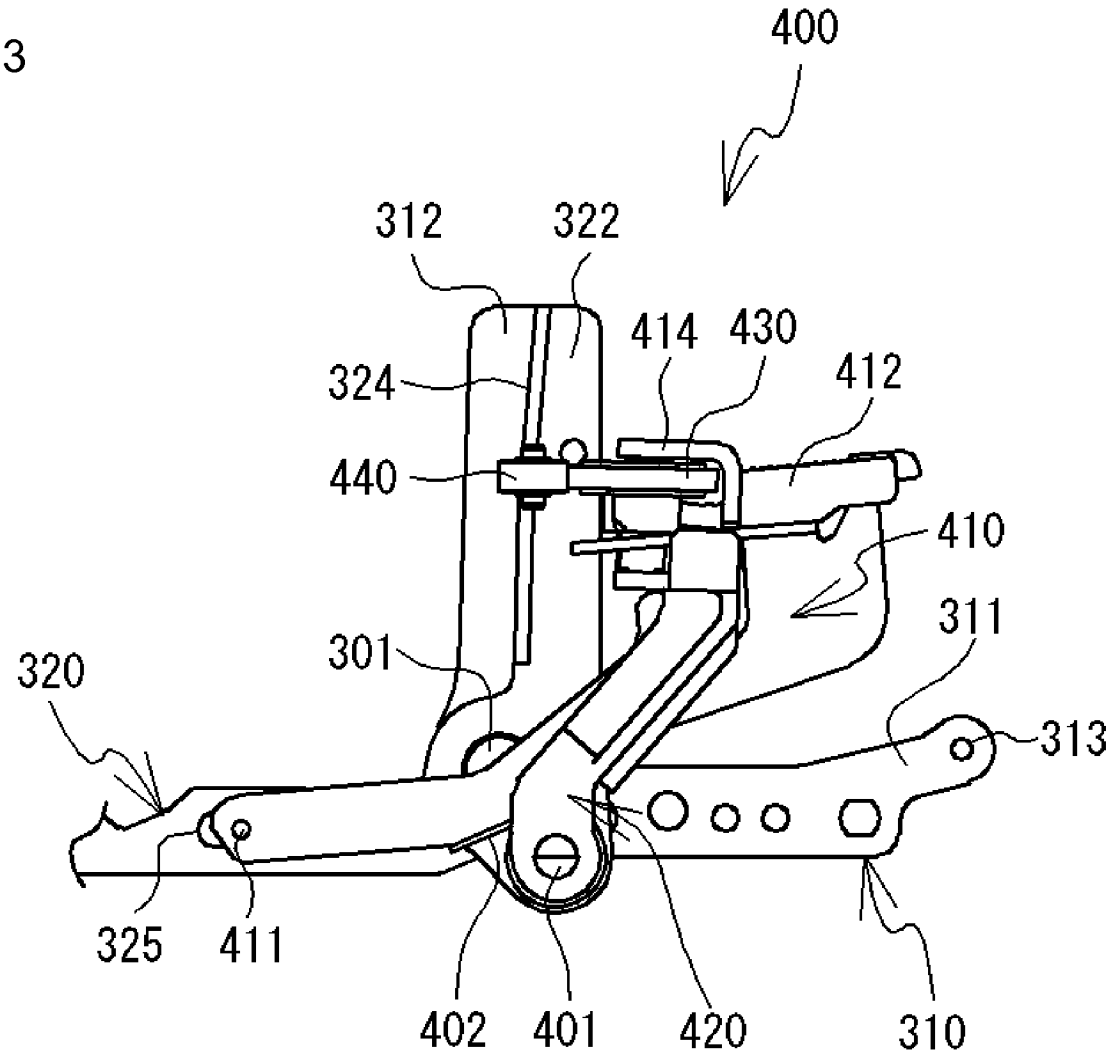
FIG. 13 is a back view of the feeding mechanism with the cam plate in the second displacement position.

As shown in FIG. 12 and FIG. 13, the second driving pin 764 that rotates in the second operation direction urges the first plate part 321 downward in the guide groove 323. As the first plate part 321 moves downward, the movable part 320 resists the elastic force of the tension spring 330 and rotates around the rotating shaft 301 in the clockwise direction in the front view. When the cam plate 760 rotates substantially 45 degrees in the second operation direction from the reference position, the movable part 320 moves from the retracted position to the cutting position. The cutting position is a position where the movable blade 324 crosses the fixed blade 314.

The rotating position of the cam plate 760 that moves the movable part 320 to the cutting position is referred to as a second displacement position. As the cam plate 760 rotates in the second operation direction from the reference position, the movable pin 91A moves relatively along the front circumferential surface 760A. When the cam plate 760 rotates to the second displacement position, the second detection plate 766 contacts the movable pin 91A. The movable pin 91A changes from the stationary state to the inclined state, causing the first detection sensor 91 to change from OFF to ON.

As the cam plate 760 rotates from the reference position to the second displacement position, the movable pin 92A moves relatively along the rear circumferential surface 760B. When the cam plate 760 rotates to the second displacement position, the protrusion part 762 contacts the movable pin 92A. The movable pin 92A changes from the stationary state to the inclined state, causing the second detection sensor 92 to change from OFF to ON. Accordingly, if both of the detection sensors 91, 92 turn ON during the reverse rotation of the cutter driving motor 90, the control portion 20 determines that the cam plate 760 has rotated to the second displacement position and stops the driving of the cutter driving motor 90.

As the cam plate 760 rotates from the reference position to the second displacement position, the locking pin 411 of the first link 410 moves toward the right end of the guide hole 325. As the locking pin 411 moves, the first link 410 rotates around the rotating shaft 401 in the clockwise direction in the front view. The second link 420 also rotates in coordination with the first link 410 via the connecting spring 402.

With this arrangement, the second link 420 moves from the retracted position to the feeding position. The feeding position is a position where the movable roller 430 contacts the tape with print facing the fixed blade 314. If the second link 420 is in the feeding position, the movable roller 430 urges the fixed roller 440. As the first link 410 rotates, the roller pressing member 412A of the operation mechanism 412 urges a first protrusion part (not shown) of the movable roller 430 by the elastic force of the spring 412C. With this arrangement, the movable roller 430 rotates a half turn while urging the fixed roller 440.

With the above movement, the print-receiving tape 57 with print is cut as follows. As the cam plate 760 rotates from the reference position to the second displacement position, the movable roller 430 presses the print-receiving tape 57 fed to the tape discharging part 110 (refer to FIG. 1) against the fixed roller 440. All layers of the print-receiving tape 57 sandwiched between the movable roller 430 and the fixed roller 440 are cut between the movable blade 324 and the fixed blade 314. That is, the print-receiving tape 57 is completely cut (fully cut). At this time, the operation mechanism 412 near the movable roller 430 rotates the movable roller 430 a half turn by the roller pressing member 412A. The cut print-receiving tape 57 is fed toward the discharging exit 111 in an amount equivalent to the distance corresponding to the half turn by the movable roller 430.

Subsequently, the control portion 20 rotates the cutter driving motor 90 forward, rotating the cam plate 760 in the first operation direction from the second displacement position. The control portion 20 rotates the cam plate 760 in the first operation direction until the second detection sensor 92 changes from ON to OFF (that is, until the protrusion part 762 separates from the movable pin 92A). If the second detection sensor 92 has changed from ON to OFF, the control portion 20 stops the driving of the cutter driving motor 90.

With this arrangement, the movable part 320 rotates around the rotating shaft 301 in the counterclockwise direction in the front view, by the elastic force of the tension spring 330. The movable part 320 moves from the cutting position to the retracted position. As the movable part 320 rotates, the second driving pin 764 that contacts the guide groove 323 rotates in the first operation direction, rotating the cam plate 760 to the reference position. As the movable part 320 rotates, the locking pin 411 moves toward the left end of the guide hole 325, rotating the first link 410 and the second link 420 around the rotating shaft 401 in the counterclockwise direction in the front view.

The second link 420 moves from the feeding position to the retracted position. As the first link 410 rotates, the hook member 412B of the operation mechanism 412 urges a second protrusion part (not shown) of the movable roller 430. With this arrangement, before the movable roller 430 separates from the fixed roller 440, the movable roller 430 rotates a half turn while urging the fixed roller 440. The cut print-receiving tape 57 is fed toward the discharging exit 111 in an amount equivalent to the distance corresponding to the half turn by the movable roller 430.

With the above movement, the cutting mechanism 80 returns to the standby state. The operation mechanism 412 thus rotates the movable roller 430 one half turn twice (that is, one turn), thereby feeding the print-receiving tape 57 in which all layers have been cut toward the discharging exit 111.

Power Supply System

Figure 14:
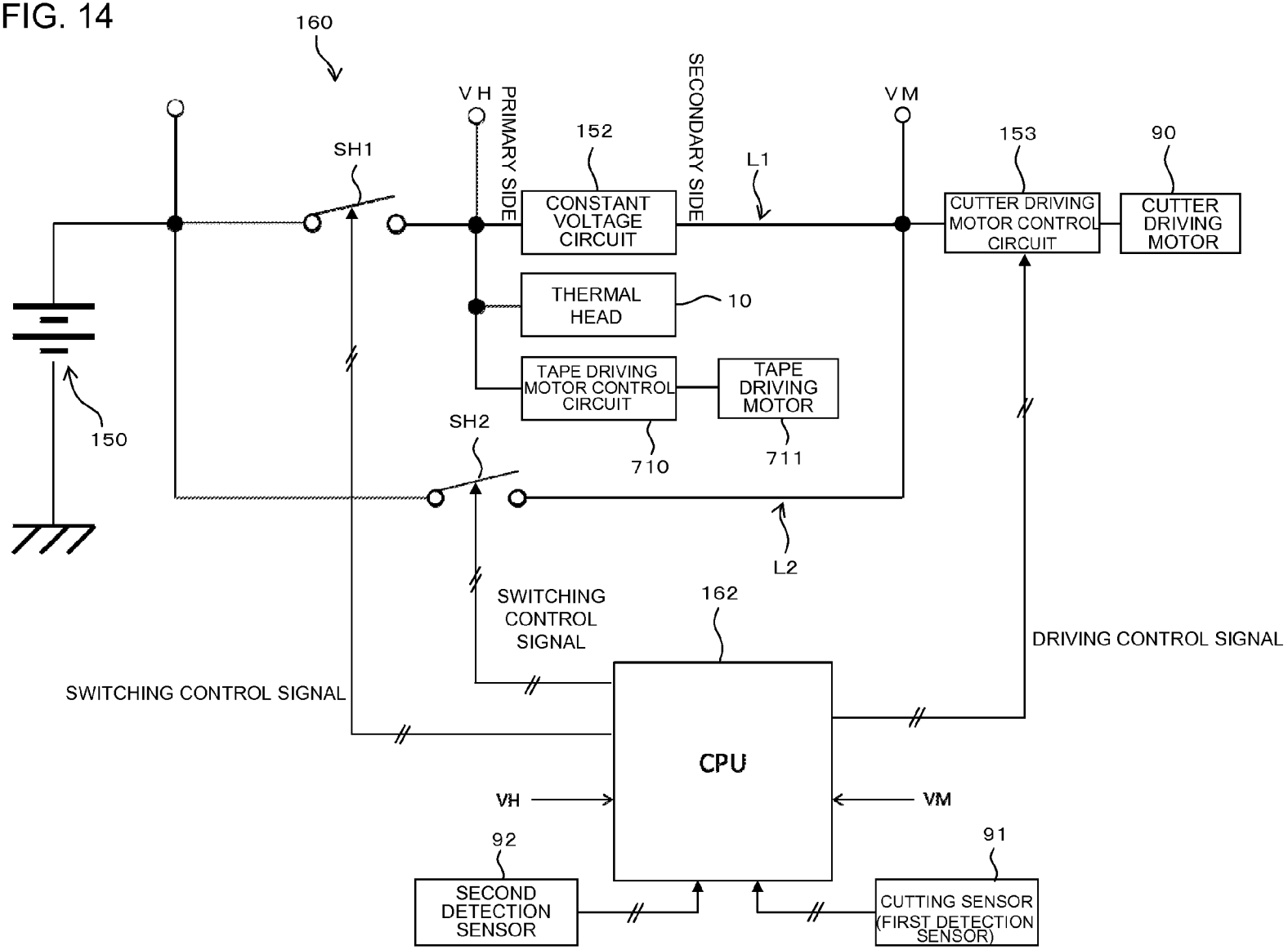
FIG. 14 is a functional block diagram showing the power supply system.

FIG. 14 is a block diagram showing a power supply system 160 disposed in the tape printer 1 with the above described configuration.

General Configuration

In FIG. 14, this power supply system 160 comprises the battery 150 stored in the above described battery storage part; the above described tape driving motor 711, the above described thermal head 10, and the above described cutter driving motor 90 driven by the current from the battery 150; a tape driving motor control circuit 710 that controls the driving of the tape driving motor 711, a cutter driving motor control circuit 153 that controls the driving of the cutter driving motor 90, and a constant voltage circuit 152.

The above described cutter driving motor 90, as already described, generates the driving force for performing the advancing and retreating movement of the cutting blade 223 of the above described half-cutting mechanism 200, and the advancing and retreating movement of the movable blade 320 of the full-cutting mechanism 300. At this time, the above described constant voltage circuit 152 is disposed to ensure that the voltage supplied to the cutter driving motor 90 does not become transitionally excessive (so that the voltage does not become greater than the rated voltage of the motor 90, for example). The constant voltage circuit 152 outputs a predetermined constant voltage to a secondary side based on a primary-side voltage supplied from the above described battery 150. The secondary side of the constant voltage circuit 152 is connected to the above described cutter driving motor control circuit 153.

Voltage Drop of Constant Voltage Circuit

However, since the constant voltage circuit 152 exhibits the above described voltage adjusting function, voltage drops up to a certain level (approximately 1.5V, for example) in the interior of the constant voltage circuit 152 cannot be avoided. Accordingly, when the battery 150 is consumed by usage of the tape printer 1 and the electromotive force has gradually decreased, the voltage supplied to the above described cutter driving motor 90 may decrease relatively quickly to or below the minimum voltage (approximately 4V, for example) capable of driving the cutting blade 223 due to the voltage drop in the above described constant voltage circuit. In this case, the cutting blade 223 may no longer be able to fully execute the partial cutting of the above described print-receiving tape 57.

Switching the Current Supply Route

Hence, according to this embodiment, a first route L1 and a second route L2 are selectively usably disposed as the current supply routes from the battery 150 to the cutter driving motor 90. The first route L1 is a route by which the constant voltage on the secondary side from the constant voltage circuit 152 is supplied to the cutter motor driving circuit 153 (as a motor driving voltage VM), based on a primary-side voltage VH from the battery 150. The second route L2 is a route by which the primary-side voltage VH from the battery 150 is supplied to the cutter motor driving circuit 153 (as the motor driving voltage VM) as is, without passing through the constant voltage circuit 152.

Then, the CPU 162 included in the above described control portion 20 detects whether or not the partial cutting by the above described cutting blade 223 has been fully executed and, triggered by non-detection of the execution of the partial cutting, switches the current supply route from the battery 150 to the motor 90 from the above described first route L1 to the above described second route L2. A first switch SH1 and a second switch SH2 connected in parallel to the battery 150 are disposed for this route switching.

The first switch SH1 connects the battery 150 and the constant voltage circuit 152 in the above described first route L1. That is, the first route L1 is configured as a current supply route from the battery 150 to the cutter driving motor control circuit 153 via the first switch SH1 and the constant voltage circuit 152. In the first route L1, the output voltage (7.5V, for example) of the battery 150 is input to the constant voltage circuit 152 as the primary-side voltage VH, the voltage (6.0V, for example) controlled at a constant voltage by the constant voltage circuit 152 is output to the cutter driving motor control circuit 153 as the secondary-side voltage, and the current controlled by the cutter driving motor control circuit 153 is supplied to the cutter driving motor 90. Note that the above described thermal head 10 and the above described tape driving motor control circuit 710 are connected in parallel to the above described constant voltage circuit 152 and the first switch SH1.

The second switch SH2 directly connects the battery 150 and the cutter driving motor control circuit 153 (without passing through the constant voltage circuit 152) in the above described second route L2. That is, the second route L2 is configured as a current supply route from the battery 150 to the cutter driving motor control circuit 15 via the second switch SH2. In the second route L2, the output voltage (that is, the primary-side voltage VH) of the battery 150 is output to the cutter driving motor control circuit 153 as is, and the current controlled by the cutter driving motor control circuit 153 is supplied to the cutter driving motor 90.

The switching control of the above described first switch SH1 and the second switch SH2 for switching the above described first route L1 and the second route L2 is performed by the CPU 162. That is, the above described first detection sensor 91 (hereinafter suitably and simply referred to as "cutting sensor 91") and the second detection sensor 92 are connected, and the detection results of these sensors 91, 92 are input to the CPU 162. Further, the primary-side voltage VH of the battery 150 and the above described motor driving voltage VM are input to the CPU 162. Then, the CPU 162 outputs the switching control signal of the first switch SH1 and second switch SH2 in accordance with the detection result of the above described cutting sensor 91, and the values of the above described primary-side voltage VH and the above described motor driving voltage VM, thereby switching the first route L1 and the second route L2 (details described later). Further, the CPU 162 outputs the driving control signal to the cutter driving motor control circuit 153, thereby causing the cutter driving motor 90 to rotate forward or in reverse (details described later).

Control Procedure

Figure 15:
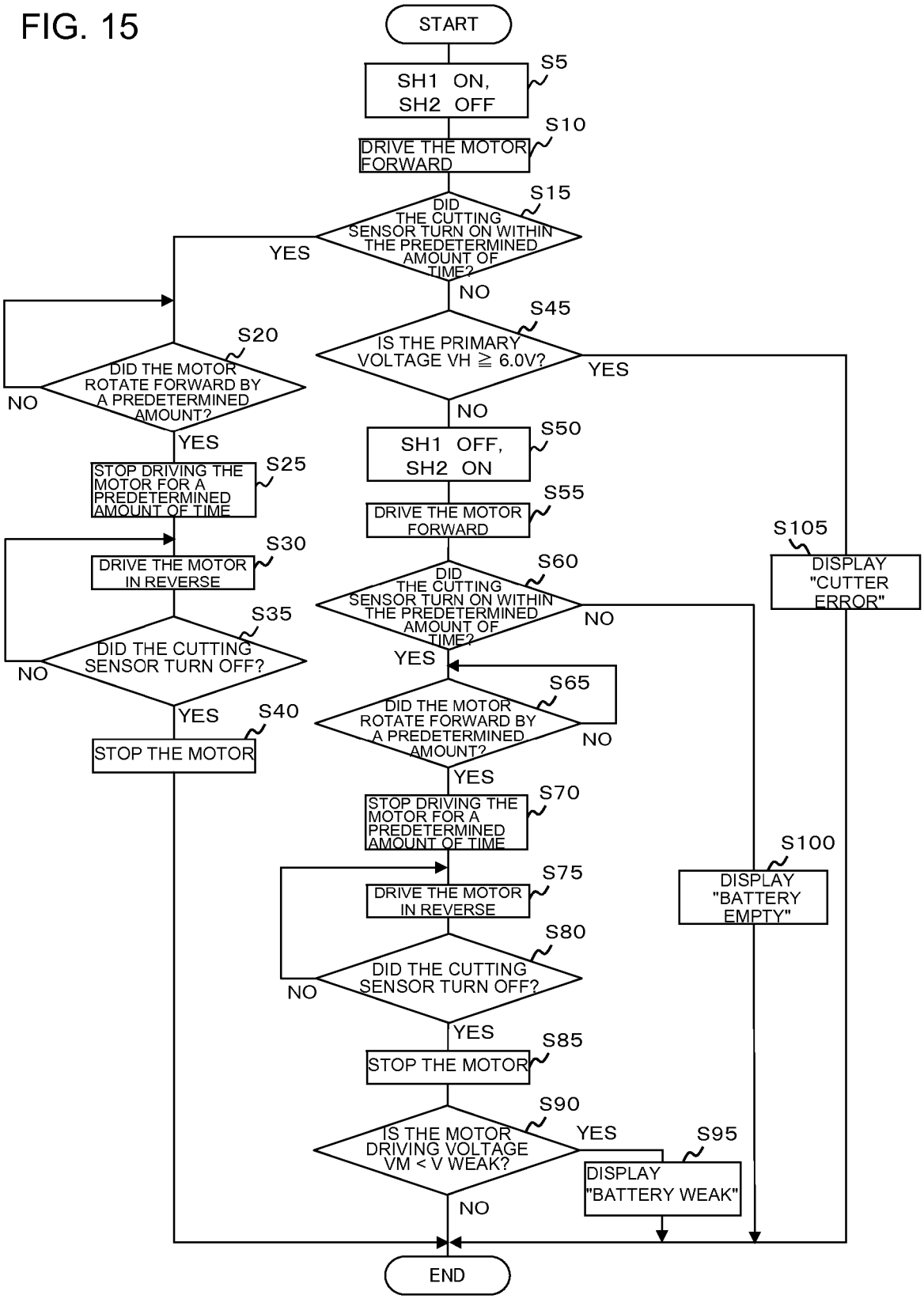
FIG. 15 is a flowchart showing the control procedure executed by the CPU.

FIG. 15 shows the control procedure executed by the CPU 162 during the execution of the partial cutting by the above described half-cutting mechanism 200 in order to achieve the above described technique.

In FIG. 15, first, in step S5, the CPU 162 outputs a switching control signal to the first switch SH1 and the second switch SH2, setting the first switch SH1 to ON (closed) and the second switch SH2 to OFF (open). With this arrangement, the current supply route from the battery 150 to the cutter driving motor 90 is switched to the first route L1 that passes through the constant voltage circuit 152. When step S5 ends, the flow proceeds to step S10.

In step S10, the CPU 162 outputs a driving control signal to the cutter driving motor control circuit 153, and drives the cutter driving motor 90 forward. With this arrangement, the cam plate 760 of the half-cutting mechanism 200 rotates in the first operation direction (in the clockwise direction in the front view) from the reference position toward the first displacement position. When step S10 ends, the flow proceeds to step S15.

In step S15, the CPU 162 determines whether or not the cutting sensor 91 turned ON within a predetermined amount of time as the above described cam plate 760 rotated in the above described step S10. When the cam plate 760 rotates to the above described first displacement position by the forward rotation of the cutter driving motor 90, the first detection plate 765 contacts the movable pin 91A as described above, turning the cutting sensor 91 ON. At the moment that the cam plate 760 rotates to the above described first displacement position (when the cutting sensor 91 turns ON), the print-receiving tape 57 is pressed against the receiving tray 213 by the cutting blade 223. The above described predetermined amount of time is set longer than the time required for the cam plate 760 to rotate from the reference position to the first displacement position during normal periods, for example. If the cutting sensor turns ON within the above described predetermined amount of time after the start of the rotation of the above described cam plate 760 in the above described step S10, the condition of this step S15 is satisfied (step S15: YES), and the flow proceeds to step S20. If the cutting sensor does not turn ON within the predetermined amount of time, the condition is not satisfied (step S15: NO), and the flow proceeds to step S45 described later.

In step S20, the CPU 162 determines whether or not the cutter driving motor 90 has further rotated forward by a predetermined amount since the cutting sensor 91 turned ON. After the cutting sensor has turned ON, the cutter driving motor 90 further rotates by a predetermined amount in order to set the rotating position of the cam plate 760 to the above described cam holding position. The cam plate 760 moved to the cam holding position by the predetermined amount of rotation is held in the cam holding position by the regulation of movement by the guide groove 233 where the first driving pin 763 is inserted, as described above. Then, the cutting blade 223 strongly urges the print-receiving tape 57 toward the receiving tray 213 while the cam plate 760 rotates from the first displacement position to the cam holding position. Until the cutter driving motor 90 rotates forward by the above described predetermined amount, the condition of step S20 is not satisfied (step S20: NO), and the flow loops back and enters a standby state. When the cutter driving motor 90 rotates forward by the above described predetermined amount, the condition is satisfied (step S20: YES), and the flow proceeds to step S25.

In step S25, the CPU 162 outputs a driving control signal to the cutter driving motor control circuit 153, and stops the driving of the cutter driving motor 90 for a predetermined amount of time. The cam plate 760 held in the cam holding position as described above is held in the cam holding position for a predetermined amount of time by this stoppage of the driving of the cutter driving motor 90 for a predetermined amount of time. As described above, the cutting blade 223 that strongly urged the print-receiving tape 57 toward the receiving tray 213 while the cam plate 760 rotated to the cam holding position continues to strongly urge the print-receiving tape 57 toward the receiving tray 213 while the cam plate 760 is held in the cam holding position. As a result, the partial cutting of the print-receiving tape 57 is executed by the cutting blade 223, and a portion (the separation layer in this example) of the print-receiving tape 57 is cut. When step S25 ends, the flow proceeds to step S30.

In step S30, the CPU 162 outputs a driving control signal to the cutter driving motor control circuit 153, and drives the cutter driving motor 90 in reverse. With this arrangement, as described above, the cam plate 760 rotates in the second operation direction (here, the counterclockwise direction in the front view) from the cam holding position toward the first displacement position. When step S30 ends, the flow proceeds to step S35.

In step S35, the CPU 162 determines whether or not the cutting sensor 91 has turned OFF. That is, as described above, when the cam plate 760 rotates to the first displacement position by the reverse driving of the cutter driving motor 90, causing the first detection plate 765 to separate from the movable pin 91A, the cutting sensor 91 turns OFF. If the cutting sensor 91 has not turned OFF, the condition is not satisfied (S35: NO), the flow returns to the above described step S30, and the same procedure is repeated. If the cutting sensor 91 has turned OFF, the condition is satisfied (step S35: YES), and the flow proceeds to step S40.

In step S40, the CPU 162 outputs a driving control signal to the cutter driving motor control circuit 153, and stops the driving of the cutter driving motor 90. With this arrangement, as described above, the first driving pin 763 is moved by the arm part 242, and the cam plate 760 rotates to the reference position as the first driving pin 763 moves. Subsequently, this process terminates here.

On the other hand, in step S45 where the flow proceeds when the condition of the above described step S15 is not satisfied (step S15: NO), the CPU 162 determines whether or not the primary-side voltage VH (which is the output voltage of the battery 150) input as described above is at least a predetermined threshold value (a value higher than the above described minimum voltage capable of driving the cutting blade 223 by a certain offset amount; a motor rated voltage of 6.0V, for example) defined in advance for the cutter driving motor 90. That is, when the battery 150 is consumed by repeated usage of the tape printer 1, the electromotive force of the battery 150, that is, the primary-side voltage VH decreases. If the primary-side voltage VH is at least the threshold value of the motor 90, the condition is satisfied (step S45: YES), and the flow proceeds to step S105.

In step S105, the CPU 162 regards the cutting blade 223 as not capable of executing the partial cutting due to a cause of mechanical obstruction (for example, movability obstruction of the cutting blade 223 due to insertion of a foreign object), outputs a control signal to a suitable display part (not shown) of the tape printer 1, and displays a warning (such as a "Cutter Error" character display, for example) indicating mechanical obstruction. Subsequently, this process terminates here.

On the other hand, in step S45, if the primary-side voltage VH is less than the threshold value of the motor 90, the condition is not satisfied (step S45: NO), and the flow proceeds to step S50. In step S50, the CPU 162 outputs switching control signals to the first switch SH1 and the second switch SH2, respectively, setting the first switch SH1 to OFF (open) and the second switch SH2 to ON (closed). With this arrangement, the current supply route from the battery 150 to the cutter driving motor 90 is switched from the first route L1 that passes through the constant voltage circuit 152 to the second route L2 that does not pass through the constant voltage circuit 152. When step S50 ends, the flow proceeds to step S55.

In step S55, the CPU 162 outputs a driving control signal to the cutter driving motor control circuit 153 and drives the cutter driving motor 90 forward by the cutter driving motor control circuit 153, in the same manner as the above described step S10. With this arrangement, as described above, the cam plate 760 rotates from the reference position toward the first displacement position. When step S55 ends, the flow proceeds to step S60.

In step S60, the CPU 162 determines whether or not the cutting sensor 91 turned ON within a predetermined amount of time, in the same manner as the above described step S15. The above described predetermined amount of time is set longer than the time required for the cam plate 760 to rotate from the reference position to the first displacement position during normal periods, for example, similar to the above. If the cutting sensor has not turned ON within the above described predetermined amount of time after the start of rotation of the cam plate 760 in the above described step S55, the condition is not satisfied (step S60: NO), and the flow proceeds to step S100.

In step S100, the CPU 162 regards the electromotive force of the battery 150 as having decreased to a level at which the partial cutting movement by the half-cutting mechanism 200 is difficult, outputs a control signal to the above described display part, and displays a warning (such as a "Battery Empty" character display, for example) indicating that the electromotive force of the battery 150 is substantially depleted on the display part. Subsequently, this process terminates here.

On the other hand, if the cutting sensor turns ON within the above described predetermined amount of time, the condition of step S60 is satisfied (step S60: YES), and the flow proceeds to step S65. In step S65, the CPU 162 determines whether or not the cutter driving motor 90 has further rotated forward by a predetermined amount since the cutting sensor 91 turned ON, in the same manner as the above described step S20. As described above, the cam plate 760 that has moved to the cam holding position by the predetermined amount of rotation is held in the cam holding position. The cutting blade 223 strongly urges the print-receiving tape 57 toward the receiving tray 213 while the cam plate 760 rotates from the first displacement position to the cam holding position. Until the cutter driving motor 90 rotates forward by the above described predetermined amount, the condition is not satisfied (step S65: NO), and the flow loops back and enters a standby state. When the cutter driving motor 90 rotates forward by the above described predetermined amount, the condition is satisfied (step S65: YES), and the flow proceeds to step S70.

In step S70, the CPU 162 outputs a driving control signal to the cutter driving motor control circuit 153, and stops the driving of the cutter driving motor 90 for a predetermined amount of time, in the same manner as the above described step S25. As described above, the cam plate 760 held for a predetermined amount of time in the cam holding position by the stoppage of the driving of the cutter driving motor 90 for a predetermined amount of time continues to strongly urge the print-receiving tape 57 toward the receiving tray 213 while held in the cam holding position. When step S70 ends, the flow proceeds to step S75.

In step S75, the CPU 162 outputs a driving control signal to the cutter driving motor control circuit 153, and drives the cutter driving motor 90 in reverse, in the same manner as the above described step S30. With this arrangement, as described above, the cam plate 760 rotates in the second operation direction (here, the counterclockwise direction in the front view) from the cam holding position toward the first displacement position. When step S75 ends, the flow proceeds to step S80.

In step S80, the CPU 162 determines whether or not the cutting sensor 91 has turned OFF, in the same manner as the above described step S35. As described above, when the cam plate 760 rotates to the first displacement position by the reverse driving of the cutter driving motor 90, causing the first detection plate 765 to separate from the movable pin 91A, the cutting sensor 91 turns OFF. If the cutting sensor 91 has not turned OFF, the condition is not satisfied (S80: NO), the flow returns to the above described step S75, and the same procedure is repeated. If the cutting sensor 91 has turned OFF, the condition is satisfied (step S80: YES), and the flow proceeds to step S85.

In step S85, the CPU 162 outputs a driving control signal to the cutter driving motor control circuit 153, and stops the driving of the cutter driving motor 90, in the same manner as the above described step S40. With this arrangement, as described above, the first driving pin 763 is moved by the arm part 242, and the cam plate 760 rotates to the reference position as the first driving pin 763 moves. Subsequently, the flow proceeds to step S90.

In step S90, the CPU 162 determines whether or not the motor driving voltage VM (equivalent to the above described secondary-side voltage since the route at this moment is switched to the first route L1) is less than a predetermined low voltage Vweak set in advance (VM<Vweak). While the predetermined voltage Vweak at this time is lower than the rated voltage (6.0V, for example) of the cutter driving motor 90, it is set to a voltage (4.5V, for example) capable of driving the motor 90. If VM<Vweak, the condition of step S90 is satisfied (step S90: YES), and the flow proceeds to step S95.

In step S95, the CPU 162 regards the electromotive force of the battery 150 as having decreased to a level that requires caution, outputs a control signal to the above described display part (not shown), and displays a warning (such as a "Battery Weak" character display, for example) indicating that the electromotive force of the battery 150 is low on the above described display part. Subsequently, this process terminates here.

On the other hand, if VM≥Vweak in the above described step S90, the condition is not satisfied (step S90: NO), the electromotive force of the battery 150 is regarded as at a level that still permits unproblematic usage (by the switching of the above described current supply route), and the flow is ended as is.

Advantages of the Embodiment

As described above, in the tape printer 1 in this embodiment, desired print is formed by the thermal head 10 on the print-receiving tape 57 fed by the tape driving roller 46. The print-receiving tape 57 after print formation is partially cut in the thickness direction by the cooperation between the cutting blade 223 and receiving tray 213, and is then ready for use by the user. The advancing and retreating movement of the cutting blade 223 that performs the above described partial cutting is performed by the driving force of the cutter driving motor 90.

The above described cutter driving motor 90 is driven by the current from the battery 150 stored in the battery storage part. At this time, the constant voltage circuit 152 is disposed so that the voltage supplied to the motor 90 does not become transitionally excessive. At this time, according to this embodiment, two current supply routes from the battery 152 to the cutter driving motor 90 are prepared: the first route L1 and the second route L2. Then, in the tape printer 1 in this embodiment, first the current supply route from the battery 150 to the cutter driving motor 90 is switched to the above described first route L1 (refer to step S5). With this arrangement, it is possible to supply stabilized constant voltage to the cutter motor 90 via the cutter motor driving circuit. Subsequently, when the electromotive force of the battery 150 decreases by the consumption resulting from usage of the tape printer 1 and the voltage supplied to the cutter motor 90 becomes less than the above described minimum voltage, the cutting blade 223 can no longer execute the above described partial cutting. Then, triggered by non-detection of the execution of partial cutting by the cutting sensor 91 (refer to step S15), the current supply route from the battery 150 to the cutter driving motor 90 is switched to the above described second route L2 (refer to step S50). With this arrangement, the current from the battery 150 is supplied to the motor 90 without passing through the above described constant voltage circuit 152, making it possible to increase the voltage supplied to the motor 90 by an amount equivalent to the amount of disappearance in voltage drop in the above described constant voltage circuit 152. As a result, the cutting blade 223 can be driven to execute the partial cutting of the above described print-receiving tape 57 (refer to steps S55-S85), making it possible to improve user convenience.

Further, in particular, according to this embodiment, if the detected primary-side voltage VH is determined to be at least the aforementioned threshold value (refer to step S45), the above described first warning that indicates mechanical obstruction with respect to the advancing and retreating movement of the cutting blade 223 is displayed (refer to step S105). This has significance such as follows.

That is, if execution of the partial cutting has not been detected by the cutting sensor 91, the possibility exists that the cause may be some kind of mechanical obstruction (mechanically locked or the like) with respect to the advancing and retreating movement of the cutting blade 223 in addition to a decrease in electromotive force by the consumption of the battery 150 such as described above. In response, according to this embodiment, if execution of the partial cutting has not been detected by the cutting sensor 91 as described above, the CPU 162 determines whether or not the above described detected primary-side voltage VH is the above described predetermined threshold value. If the condition is satisfied, the cutting blade 223 does not move, regardless of whether or not the voltage supplied to the cutter driving motor 90 is sufficiently high. Accordingly, the first warning indicating mechanical obstruction of the above described cutting blade 223 is displayed on the display part. With this arrangement, the user can correctly recognize that the reason why the partial cutting movement of the cutting blade 223 cannot be performed is not consumption of the battery 150, but rather another mechanical cause.

Further, in particular, according to this embodiment, if execution of the partial cutting is detected by the cutting sensor 91 with the above described current supply route switched to the above described second route L2 (and, in this example, further given the condition that VM<Vweak), the above described second warning indicating a decrease in the electromotive force of the battery 150 is displayed (refer to step S95). This has significance such as follows.

That is, if the cutting blade 223 can be moved by the switching of the current supply route from the aforementioned first route L1 to the second route L2, the voltage supplied to the cutter driving motor 90 becomes less than the above described minimum voltage when a voltage drop in the constant voltage circuit 152 occurs, while the voltage supplied to the motor 90 becomes at least the above described minimum voltage when the voltage drop disappears. That is, the battery 150 is consumed to a certain extent, decreasing the electromotive force.

Hence, in this embodiment, in such a case, the second warning indicating that the electromotive force of the above described battery 150 is low is displayed on the above described display part. With this arrangement, the user can correctly recognize that the reason why the partial cutting movement of the cutting blade 223 cannot be performed is consumption of the battery 150 (the battery 150 has already been consumed to a certain extent).

Further, in particular, according to this embodiment, if execution of the partial cutting is not detected by the cutting sensor 91 with the above described current supply route switched to the second route L2, the above described third warning indicating that the electromotive force of the battery 150 is substantially depleted is displayed (refer to step S100). This has significance such as follows.

If the cutting blade 223 cannot be moved by the aforementioned switching of the current supply route from the first route L1 to the second route L2, the voltage supplied to the cutter driving motor 90 is less than the above described minimum voltage, even if the above described voltage drop in the constant voltage circuit 152 disappears. That is, the battery 150 is considerably consumed, substantially depleting the electromotive force for moving the tape printer 1.

Hence, in this embodiment, in such a case, the third warning indicating that the electromotive force of the above described battery 150 is substantially depleted is displayed on the above described display part. With this arrangement, the user can correctly recognize that the battery 150 is significantly consumed.

Note that, in the above, the arrows shown in FIG. 14 denote examples of signal flow, but the signal flow direction is not limited thereto.

Also note that the present disclosure is not limited to the procedures shown in the above described flow of the flowchart in FIG. 15; procedure additions and deletions as well as sequence changes may be made without deviating from the spirit and scope of the disclosure.

Further, other than that already stated above, techniques based on the above described embodiments may be suitably utilized in combination as well.

What is claimed is:

1. A printer comprising:

a feeder configured to feed a long recording medium;

a printing head configured to perform desired printing on said recording medium fed by said feeder;

a movable blade that is configured to partially cut said recording medium in a thickness direction by performing a advancing and retreating movement in a direction orthogonal to a feeding path of said recording medium, and is provided near said feeding path by said feeder;

a blade receiving member that is configured to receive said movable blade that advances toward said feeding path and to perform said partial cutting in coordination with said movable blade, and is provided on a side opposite said movable blade, sandwiching said feeding path;

a battery storage part configured to store at least a battery;

a motor configured to generate a driving force for performing said advancing and retreating movement of said movable blade;

a constant voltage circuit configured to output a constant voltage to a secondary side based on a primary-side voltage supplied from said battery stored in said battery storage part;

a route switching device configured to selectively switch a current supply route from said battery to said motor to either one of a first route by which said constant voltage on said secondary side from said constant voltage circuit is supplied based on said primary-side voltage from said battery, and a second route by which said primary-side voltage from said battery is supplied without passing through said constant voltage circuit;

a cutting detection device configured to detect whether performance or non-performance of said partial cutting on said recording medium by said movable blade has occurred; and a switching control portion configured to control said route switching device so that, when triggered by said detection of said non performance of said partial cutting with said current supply route switched to said first route by said route switching device, said current supply route is switched from said first route to said second route.

2. The printer according to claim 1, wherein:

said constant voltage circuit outputs said constant voltage equal to a rated voltage of the motor or less than the rated voltage of the motor.

3. The printer according to claim 1, wherein:

said cutting detection device is a first sensor configured to mechanically detect that said movable blade has moved from a retracted position and arrived at a cutting position.

4. The printer according to claim 3, wherein:

said switching control portion controls said route switching device so that said current supply route switches from said first route to said second route when said first sensor does not detect arrival of said movable blade at said cutting position within a predetermined amount of time.

5. The printer according to claim 1, further comprising:

a primary-side voltage detecting portion configured to detect said primary-side voltage;

a display device configured to perform a desired display;

a determining portion configured to determine whether or not said primary-side voltage detected by said primary-side voltage detecting portion is not less than a predetermined threshold value when execution of said partial cutting is not detected by said cutting detection device with said current supply route switched to said first route by said route switching device; and a first display control portion configured to control said display device so that a first warning indicating mechanical obstruction with respect to said advancing and retreating movement of said movable blade is displayed if said determining portion determines that said primary-side voltage is not less than said threshold value; wherein said switching control portion controls said route switching device so that said current supply route switches from said first route to said second route in the case that said determining portion determines that said primary-side voltage is less than said threshold value.

6. The printer according to claim 5, wherein:

said threshold value is a value acquired by adding a predetermined offset value to a minimum voltage capable of driving said movable blade.

7. The printer according to claim 5, wherein:

said threshold value is a rated voltage of said motor.

8. The printer according to claim 5, further comprising:

a second display control portion configured to control said display device so that, triggered by detection of execution of said partial cutting by said cutting detection device with said current supply route switched to said second route by said route switching device based on control by said switching control portion, a second warning indicating that an electromotive force of said battery is low is displayed.

9. The printer according to claim 8, wherein:

said cutting detection device is a second sensor configured to mechanically detect that said movable blade has moved from a retracted position and arrived at a cutting position, and subsequently separated from said cutting position; and said second display control portion controls said display device so that, triggered by detection of the arrival of said movable blade at said cutting position and subsequent separation of said movable blade from said cutting position by said second sensor, said second warning is displayed.

10. The printer according to claim 5, further comprising:

a third display control portion configured to control said display device so that a third warning indicating that an electromotive force of said battery is substantially depleted is displayed if said cutting detection device does not detect execution of said partial cutting with said current supply route switched to said second route by said route switching device based on control by said switching control portion.

11. The printer according to claim 10, wherein:

said cutting detection device is a first sensor configured to mechanically detect that said movable blade has moved from a retracted position and arrived at a cutting position; and said third display control portion controls said display device so that said third warning is displayed when said first sensor does not detect the arrival of said movable blade at said cutting position within a predetermined amount of time.

12. A printer comprising:

a feeder configured to feed a long recording medium;

a printing head configured to perform desired printing on said recording medium fed by said feeder;

a movable blade that is configured to partially cut said recording medium in a thickness direction by performing a advancing and retreating movement in a direction orthogonal to a feeding path of said recording medium, and is provided near said feeding path by said feeder;

a blade receiving member that is configured to receive said movable blade that advances toward said feeding path and to perform said partial cutting in coordination with said movable blade, and is provided on a side opposite said movable blade, sandwiching said feeding path;

a battery storage part configured to store at least a battery;

a motor configured to generate a driving force for performing said advancing and retreating movement of said movable blade;

a constant voltage circuit configured to output a constant voltage to a secondary side based on a primary-side voltage supplied from said battery stored in said battery storage part;

a cutting detection device configured to detect whether performance or non-performance of said partial cutting on said recording medium by said movable blade has occurred;

a processor; and one or more memories storing non-transitory computer readable instructions that, when executed by the processor, cause the processor to:

selectively switch a current supply route from said battery to said motor to either one of a first route by which said constant voltage on said secondary side from said constant voltage circuit is supplied based on said primary-side voltage from said battery, and a second route by which said primary-side voltage from said battery is supplied without passing through said constant voltage circuit; said switching from said first route to said second route triggered by said detection of said non-performance of said partial cutting.

* * * * *